US005692886A

United States Patent [19]

Kobayashi et al.

[11] Patent Number: 5,692,886

[45] Date of Patent: Dec. 2, 1997

[54] CANNED MOTOR PUMP HAVING CONCENTRIC BEARINGS

[75] Inventors: Makoto Kobayashi; Masakazu Yamamoto; Yoshio Miyake; Koji Isemoto; Keita Uwai, all of Fujisawa, Japan

[73] Assignee: Ebara Corporation, Tokyo, Japan

[21] Appl. No.: 724,009

[22] Filed: Sep. 30, 1996

Related U.S. Application Data

[63] Continuation of Ser. No. 354,818, Dec. 8, 1994, abandoned.

[30] Foreign Application Priority Data

Dec. 8, 1993 [JP] Japan ..... 5-340528
Dec. 22, 1993 [JP] Japan ..... 5-346246

[51] Int. Cl.[6] ..... F04B 17/00

[52] U.S. Cl. ..... 417/423.12; 417/423.1; 417/366; 415/111

[58] Field of Search ..... 417/365, 368, 417/377, 360, 423.1, 423.12, 423.15, 423.14; 415/111, 229

[56] References Cited

U.S. PATENT DOCUMENTS

| | | | |
|---|---|---|---|
| 2,246,777 | 6/1941 | Bordeaux . | |
| 3,138,105 | 6/1964 | White | 417/423.1 |
| 5,184,945 | 2/1993 | Chi-Wei | 417/423.12 |

FOREIGN PATENT DOCUMENTS

| | | | |
|---|---|---|---|
| 88 954 | 3/1962 | France . | |
| 1299237 | 6/1962 | France . | |
| 3421374 | 6/1985 | Germany | 415/111 |
| 42 03 482 | 8/1993 | Germany . | |
| 50-144101 | 11/1975 | Japan . | |
| 1 180 598 | 2/1970 | United Kingdom . | |
| 90010161 | 9/1990 | WIPO | 415/229 |

*Primary Examiner*—Timothy Thorpe
*Assistant Examiner*—Ted Kim
*Attorney, Agent, or Firm*—Oblon, Spivak, McClelland, Maier & Neustadt, P.C.

[57] ABSTRACT

A canned motor pump has relative small size and low output power for use in, for example, circulating warm water. The canned motor pump comprises a motor stator, a stator can disposed radially inwardly of the motor stator and in which a fluid passage of a main flow of a pumped fluid is defined, a rotatable shaft, a motor rotor fixedly supported on an end of the rotatable shaft and disposed radially inwardly of the stator can, a pump impeller mounted on an opposite end of the rotatable shaft, and all radial bearings for supporting the rotatable shaft disposed between the motor rotor and the pump impeller.

12 Claims, 18 Drawing Sheets

CANNED MOTOR PUMP HAVING CONCENTRIC BEARINGS

This application is a Continuation of application Ser. No. 08/354,818, filed on Dec. 08, 1994, now abandoned.

BACKGROUND OF THE INVENTION

1. Field of the Invention

The present invention relates to a canned motor pump, and more particularly to a canned motor pump of relative small size and low output power for use in, for example, circulating warm water.

2. Description of the Prior Art

There has been known a canned motor pump in which a main fluid stream flows radially inwardly of the stator of an electric motor. One example of such a canned motor pump is disclosed in Japanese utility model publication No. 57-10205. FIG. 20 of the accompanying drawings shows the disclosed canned motor pump. As shown in FIG. 20, the canned motor pump has a frame 10 and side covers 11, 12 mounted respectively on opposite ends of the frame 10 and having respective inlet and outlet ports 11', 12' defined therein. The canned motor pump also has a motor shaft 13 rotatably supported horizontally in the frame 10 by two axially spaced bearings 14, and an impeller 15 fixed to one end of the motor shaft 13 so that the impeller 15 can be rotated when the motor shaft 13 is rotated about its own axis.

The bearings 14 are fixedly mounted on a bearing holder 26 and the side cover 12, respectively. The motor shaft 13 can be rotated by a rotor 16 which is fixedly disposed around the motor shaft 13 and supported thereon by a support 17. The rotor 16 and the support 17 are immersed in a fluid that is fed by the canned motor pump. The canned motor pump also includes a stator 18 disposed between the rotor 16 and the frame 10 in radially confronting relation to the rotor 16. The stator 18 is completely isolated from the fluid by a can 19 of stainless steel that is positioned in the radial gap between the rotor 16 and the stator 18.

Can plates 20 are joined at a substantially right angle to the respective opposite ends of the can 19. The can plates 20 and the can 19 jointly seal the stator 18 within the frame 10.

Other canned motor pumps in which a main fluid stream flows radially inwardly of the stator of an electric motor are also disclosed in Japanese laid-open utility model publication No. 48-83402 and Japanese utility model publication No. 62-8397. For reducing a loss of the main fluid stream, the canned motor pump has a simple axial-flow impeller installed as disclosed in the former publication or a spiral rotor column as disclosed in the latter publication.

The conventional canned motor pump shown in FIG. 20 has suffered the following problems:

The bearings 14 cannot fully be kept concentrically with each other. Specifically, the bearings 14 are fixedly mounted on the bearing holder 26 and the side cover 12, respectively, which are positioned independently one on each side of the stator 18. Therefore, it is difficult to position the bearings accurately concentrically with each other due to assembling and machining accuracy limitations. Recently, the bearings 14 are often made of a hard, brittle material such as silicon carbide (SiC) for increased service life, with reduced gaps between sliding parts thereof. In the absence of sufficient bearing concentricity, the bearings 14 of such a hard, brittle material tend to crack easily under undue stresses.

The fluid passage defined through the canned motor pump has a large hydrodynamic loss because the bearing 14 mounted on the side cover 12 presents an obstacle which prevents the fluid, once collected in the axial center of the pump, from being smoothly introduced into the outlet port 12'.

The canned motor pump has two side covers 11, 12 which are held in contact with the fluid. If these side covers 11, 12 are to be resistant to corrosion, then they have to be changed in their entity including those portions which are not held in actual contact with the fluid. The side cover 12, particularly, is of a structure that cannot easily be machined to shape as it has a fluid passage around the bearing 14 mounted thereon.

The canned motor pumps disclosed in Japanese laid-open utility model publication No. 48-83402 and Japanese utility model publication No. 62-8397 are not concerned with a positive improvement of Q-H characteristics and have a structural problem as to their effectiveness to lower a fluid loss. The canned motor pump disclosed in Japanese laid-open utility model publication No. 48-83402 has a fluid passage window which tends to break away the fluid at its edges, reducing the pump efficiency and producing noise especially when the pump operates to feed the fluid at a large rate.

The spiral rotor column of the canned motor pump disclosed in Japanese utility model publication No. 62-8397 has a height reduced progressively from one end to the other. This configuration is liable to generate a circumferential secondary fluid flow, increasing the fluid loss.

On the other hand, heretofore, electric motors have a rotor rotatably supported by two bearings disposed one on each axial side of the rotor. Therefore, the electric motors are axially elongate due to the required dimensions of the bearings. The two bearings are fixed to separate members, respectively, which are required to be fitted and assembled with high accuracy in order to keep the bearings concentric with each other.

It has been customary for motor frames to be made up of castings. However, more and more motor frames are being made of sheet metal for increased productivity. Since sheet metal is of poor rigidity and tends to vibrate easily, members which securely support motor bearings are still in the form of castings. Specifically, as shown in FIG. 21 of the accompanying drawings, a conventional electric motor has upper and lower bearings 270, 271 supported by respective bearing brackets 272, 273, and a motor frame 274 of sheet metal gripped between the bearing brackets 272, 273 and secured in position by through bolts 275.

For increased productivity in mass production environments, it is most effective and efficient to press metal sheets into cup-shaped motor frames.

SUMMARY OF THE INVENTION

It is therefore an object of the present invention to provide a canned motor pump which has bearings that can easily be positioned concentrically with each other, has a fluid passage with a reduced hydrodynamic loss, has increased pump efficiency, and can be assembled through a simple process.

Another object of the present invention is to provide a canned motor pump including compact members held in contact with a fluid handled by the canned motor pump, so that the canned motor pump is highly resistant to corrosion and can be manufactured with high productivity.

Still another object of the present invention is to provide a canned motor pump which is designed to reduce a fluid loss and relies upon positive use of an axial-flow impeller for higher pump efficiency and improved Q-H characteristics that the user will find easy to use.

Still another object of the present invention is to provide an electric motor which has a motor frame that can be manufactured with increased productivity, can easily be assembled and disassembled, and is of a small size, and a pump device which incorporates such an electric motor.

According to a first aspect of the present invention, there is provided a canned motor pump comprising: a motor stator; a stator can disposed radially inwardly of the motor stator, a fluid passage of a main flow of a pumped fluid being defined inside the stator can; a rotatable shaft; a motor rotor fixedly supported on an end of the rotatable shaft and disposed radially inwardly of the stator can; a pump impeller mounted on an opposite end of the rotatable shaft; and all radial bearings for supporting the rotatable shaft disposed between the motor rotor and the pump impeller.

With the above structure, the rotor is mounted on one end of the shaft and the impeller on the other end thereof with the radial bearings positioned between the rotor and the impeller, the radial bearings being supported by the single bearing bracket. Therefore, the radial bearings can easily be held concentric with each other.

The canned motor pump may further comprise all thrust bearings for supporting the rotatable shaft disposed between the motor rotor and the pump impeller. The bearing bracket may have a hole for removing air and water from a rotor chamber in which the motor rotor is disposed.

The canned motor pump may further comprise a power supply cable connected to the motor stator and disposed closely to the pump impeller. At least one of the bearings may be disposed in the motor rotor.

The canned motor pump may further comprise a rotor support ring for supporting said motor rotor, said rotor support ring including a boss fixedly mounted on the shaft, an outer ring held in engagement with an inner circumferential surface of said motor rotor, and a plurality of ribs interconnecting said boss and said outer ring. The ribs may be shaped as an axial-flow impeller.

The canned motor pump may further comprise a stator assembly including the motor stator and the stator can, a rotor assembly including the motor rotor, the rotatable shaft and the bearings, and a pump casing assembly housing the pump impeller can be assembled independently of each other. The stator assembly and the pump casing assembly can be assembled onto the rotor assembly in one direction when the stator assembly, the rotor assembly, and the pump casing assembly are assembled together.

The rotor may include a can side wall and a rotor can, the can side wall being sealingly welded to the rotor support ring, the rotor can being sealingly welded to the can side wall. The rotor may include an end ring held by the can side wall and the rotor can, the can side wall being tapered along an inner circumferential surface of the end ring to guide the fluid smoothly therealong.

According to a second aspect of the present invention, there is also provided a canned motor pump comprising: a motor stator; a stator can disposed radially inwardly of the motor stator, a fluid passage of a main flow of a pumped fluid being defined inside the stator can; a rotatable shaft; a motor rotor fixedly supported on an end of the rotatable shaft and disposed radially inwardly of the stator can; a pump impeller mounted on an opposite end of the rotatable shaft, the stator can having an axial end opening toward the pump impeller; and a nozzle joined to an opposite axial end of the stator can for passage of the main flow therethrough.

With the above structure, the stator can has an axial end opening toward the pump casing assembly, and the other axial end integrally joined to the nozzle through which the fluid passes. Since only an inner surface of the nozzle, which is simple in shape, is exposed to the fluid in an outlet region remote from the pump casing assembly, only the nozzle is required to be made of a corrosion-resistant material in the outlet region. In the conventional device shown in FIG. 20, the side cover 12 in its entirety is required to be made of a corrosion-resistant material, and hence is relatively expensive.

The canned motor pump may further comprises a cup-shaped motor frame for housing the motor stator, the cup-shaped motor frame having a bottom wall with a hole into which the nozzle is fitted.

The canned motor pump may further comprise a pipe joint connected to the nozzle. The motor frame may have an end gripped between the nozzle and the pipe joint.

The canned motor pump may further comprise a rotation prevention mechanism interposed between the nozzle and the motor frame for preventing the nozzle and the motor frame from rotating relatively to each other.

The motor frame and the nozzle may be joined to each other either directly or through a pipe joint.

The canned motor pump may further comprise a plurality of bearings mounted on the rotatable shaft, and a bearing bracket, the bearings being fixedly mounted on the bearing bracket, the bearing bracket having a hole for removing air and water from a rotor chamber in which the motor rotor is disposed.

According to a third aspect of the present invention, there is also provided a canned motor pump comprising: a motor frame; a motor stator fitted in the motor frame; a stator can disposed radially inwardly of the motor stator, a fluid passage of a main flow of a pumped fluid being defined inside the stator can; a rotatable shaft; a motor rotor fixedly supported on an end of the rotatable shaft and disposed radially inwardly of the stator can; a pump impeller mounted on an opposite end of the rotatable shaft; and a nozzle joined to the motor frame for passage of the main flow therethrough; wherein the stator can has axial ends, one of which is opening toward the pump impeller, the other of which is connected to the motor frame.

With the above structure, the stator can has an axial end opening toward the pump casing assembly, and the other axial end joined to the motor frame to which the nozzle is joined. If the motor frame is made of a stainless steel sheet, then since the stator can is joined to the motor frame and the nozzle is joined to the motor frame, the stator can is protected from various external forces that are applied to the nozzle.

According to a fourth aspect of the present invention, there is also provided a motor pump comprising: a motor stator; a rotatable shaft; a motor rotor fixedly supported on an end of the rotatable shaft and disposed radially inwardly of the motor stator; a pump impeller mounted on an opposite end of the rotatable shaft; axially spaced radial bearings for supporting the rotatable shaft disposed between the motor rotor and the pump impeller; a bearing bracket having a housing for housing the radial bearings, the housing having an inside diameter substantially equal to an outside diameter of the radial bearings; and an axial spacer housed in the housing and disposed between the radial bearings to keep the radial bearings spaced from each other.

With the above structure, the housing of the bearing bracket is free of concentricity errors, i.e., remains accurately concentric throughout its length, because it can be machined in one axial direction. Specifically, inasmuch as the housing does not need to be machined in two opposite directions in two steps, the axial ends of the housing are held concentric with each other. As a result, the housing and hence the bearing bracket do not cause sliding surfaces of the radial bearings to suffer localized abutment against each other. Therefore, the radial bearings made of a hard ceramic material such as SiC are protected from cracks which would otherwise occur if their sliding surfaces were subjected to localized abutment against each other.

Motor pumps with cantilevered shafts tend to suffer radial shaft displacements due to concentricity errors on account of a short span or distance between the bearings. When the shaft undergoes such a radial shaft displacement, the rotor may be brought into contact with the stator, resulting in fatal damage to the pump. The axial spacer is, however, effective to keep a desired axial distance between the radial bearings on the cantilevered shaft.

The bearings may comprise plain bearings, respectively, or may be made of ceramics.

According to a fifth aspect of the present invention, there is also provided a canned motor pump comprising a motor stator; a stator can disposed radially inwardly of the motor stator, a fluid passage of a main flow of a pumped fluid being defined inside the stator can; a rotatable shaft; a motor rotor fixedly supported on the rotatable shaft and disposed radially inwardly of the stator can; a pump impeller mounted on an end of the rotatable shaft; a rotor support ring held in engagement with an inner circumferential surface of the motor rotor; a boss mounted on the rotatable shaft; and an axial-flow impeller radially connecting the rotor support ring and the boss to each other.

With the above structure, the rotor support ring and the boss are radially connected to each other by the ribs which is shaped as the axial-flow impeller for reducing a fluid loss radially inwardly of the rotor. The axial-flow impeller and the impeller jointly provide a multistage pump for producing a high pump head which can be achieved without increasing the outside diameter of the impeller. Accordingly, the canned motor pump may be reduced in size.

The canned motor pump may further comprise a can side wall and a rotor can, the motor rotor being sealingly encased by the rotor support ring, the can side wall, and the rotor can, the can side wall being tapered to guide the fluid smoothly.

The canned motor pump may further comprise a plurality of bearings supporting the rotatable shaft, and at least one bearing bracket housing the bearings, the bearing bracket being positioned downstream of the motor rotor having a plurality of radial ribs shaped to guide the fluid smoothly.

According to a sixth aspect of the present invention, there is also provided a canned motor pump comprising: a motor stator; a stator can disposed radially inwardly of the motor stator, a fluid passage of a main flow of a pumped fluid being defined inside the stator can; a rotatable shaft; a motor rotor fixedly supported on the rotatable shaft and disposed radially inwardly of the stator can; a centrifugal pump impeller mounted on an end of the rotatable shaft; and an axial-flow impeller disposed in the motor rotor, the axial-flow impeller having a flow rate curve which is on a lower flow rate side than a flow rate curve of the centrifugal pump impeller.

With the above structure, the Q-H characteristic curve of the canned motor pump is a combination of a flow rate curve produced by the centrifugal vanes of the impeller and a flow rate curve produced by the axial vanes of the axial-flow impeller, the flow rate curve being on a lower flow rate side than the flow rate curve. Generally, the operating point of a circulating pump varies due to aging of the piping system such as corrosion and incrustation, and the pump is required to have a small change in the flow rate in response to a change in the pump head, i.e., to have a steeper Q-H characteristic curve. The combined Q-H characteristic curve of the canned motor pump is made steeper because the flow rate curve is on a lower flow rate side than the flow rate curve.

The axial-flow impeller may have a plurality of vanes each having a hole defined therein for preventing the fluid flowing along the vane from being separated therefrom.

Alternatively, the axial-flow impeller may have a plurality of vanes each composed of spaced vane segments for preventing the fluid flowing along the vane from being separated therefrom.

According to a seventh aspect of the present invention, there is provided an electric motor comprising: a stator assembly including a stator; a rotatable shaft having a coupling end for transmitting motor power; a rotor rotatably disposed in the stator assembly and fixedly supported on an end of the shaft opposite to the coupling end; and all bearings for supporting the shaft disposed between the coupling end and the rotor.

With the above structure, the two bearings are fixedly housed in the bearing bracket which is fixed to the motor frame closely to the end as the coupling. The bearing bracket is preferably in the form of a casting so that it will not vibrate easily.

Since the regions which support the bearings are machined on the same bearing bracket, the bearings are held concentrically with each other highly accurately. Because the motor frame is not required to securely support the bearings the motor frame can be pressed from a relatively thin metal sheet into a cup shape, and hence the productivity of the motor frame is increased. The electric motor requires no upper bearing bracket.

At least one of the bearings may be disposed in the rotor assembly. The electric motor may further comprise a bearing bracket which holds the bearings disposed therein, the bearing bracket and the stator assembly being capable of being assembled and disassembled independently of each other. The electric motor may further comprises a cup-shaped motor frame for housing, the stator assembly, the cup-shaped motor frame having an open end through which the bearing bracket is installed.

The electric motor may further comprise a rotor support ring for supporting the rotor, the rotor support ring including a boss fixedly mounted on the end of the shaft, an outer ring held in engagement with an inner circumferential surface of the rotor, and a plurality of ribs interconnecting the boss and the outer ring. The ribs are shaped as an impeller for producing an axial flow of a fluid.

The stator assembly may be housed in a cup-shaped motor frame having a hole defined in an axial panel thereof. A terminal box may be disposed in the hole in the axial panel of the motor frame for electric connection.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

A canned motor pump according to a first embodiment of the present invention will first be described below with reference to FIGS. 1 through 6.

Figure 1:
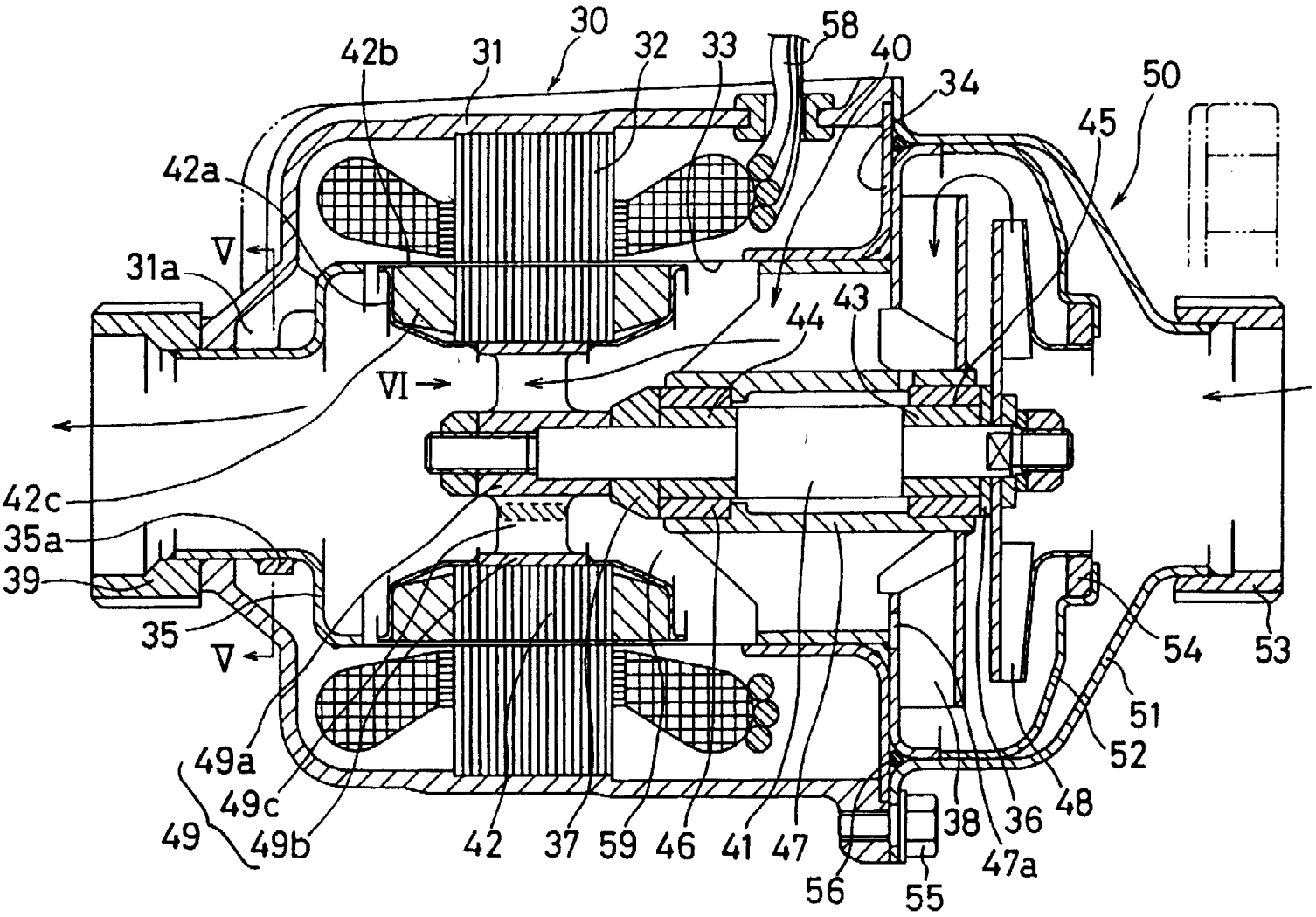
FIG. 1 is a cross-sectional view of a canned motor pump according to a first embodiment of the present invention.

FIG. 1 shows in cross section the canned motor pump according to the first embodiment of the present invention. The canned motor pump shown in FIG. 1 is in the form of an in-line-type pump comprising a stator assembly 30, a rotor assembly 40, a pump casing assembly 50, and fastening members including bolts, gaskets, etc.

Figure 2:
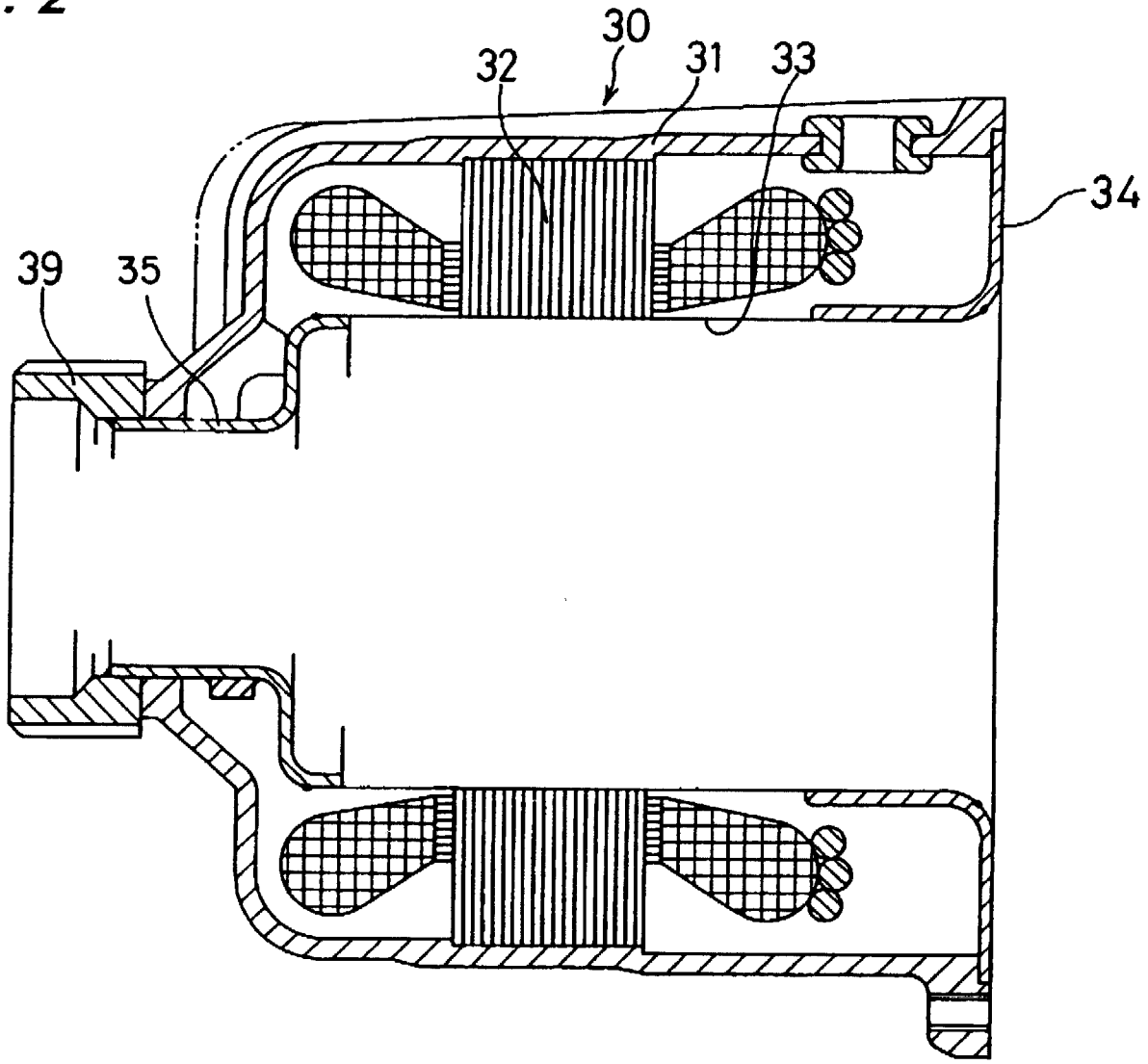
FIG. 2 is a cross-sectional view of a stator assembly of the canned motor pump shown in FIG. 1.

As shown in FIG. 2, the stator assembly 30 comprises a cup-shaped motor frame 31, a stator 32 fixedly disposed in the cup-shaped motor frame 31, a stator can 33 disposed in the stator 32 radially inwardly of the stator 32, a can holder 34 joined to one axial side of the stator can 33 for holding the stator can 33 in the motor frame 31, a nozzle 35 connected to the other axial side of the stator can 33, and a nozzle ring 39 mounted on the distal end of the nozzle 35.

Figure 3:
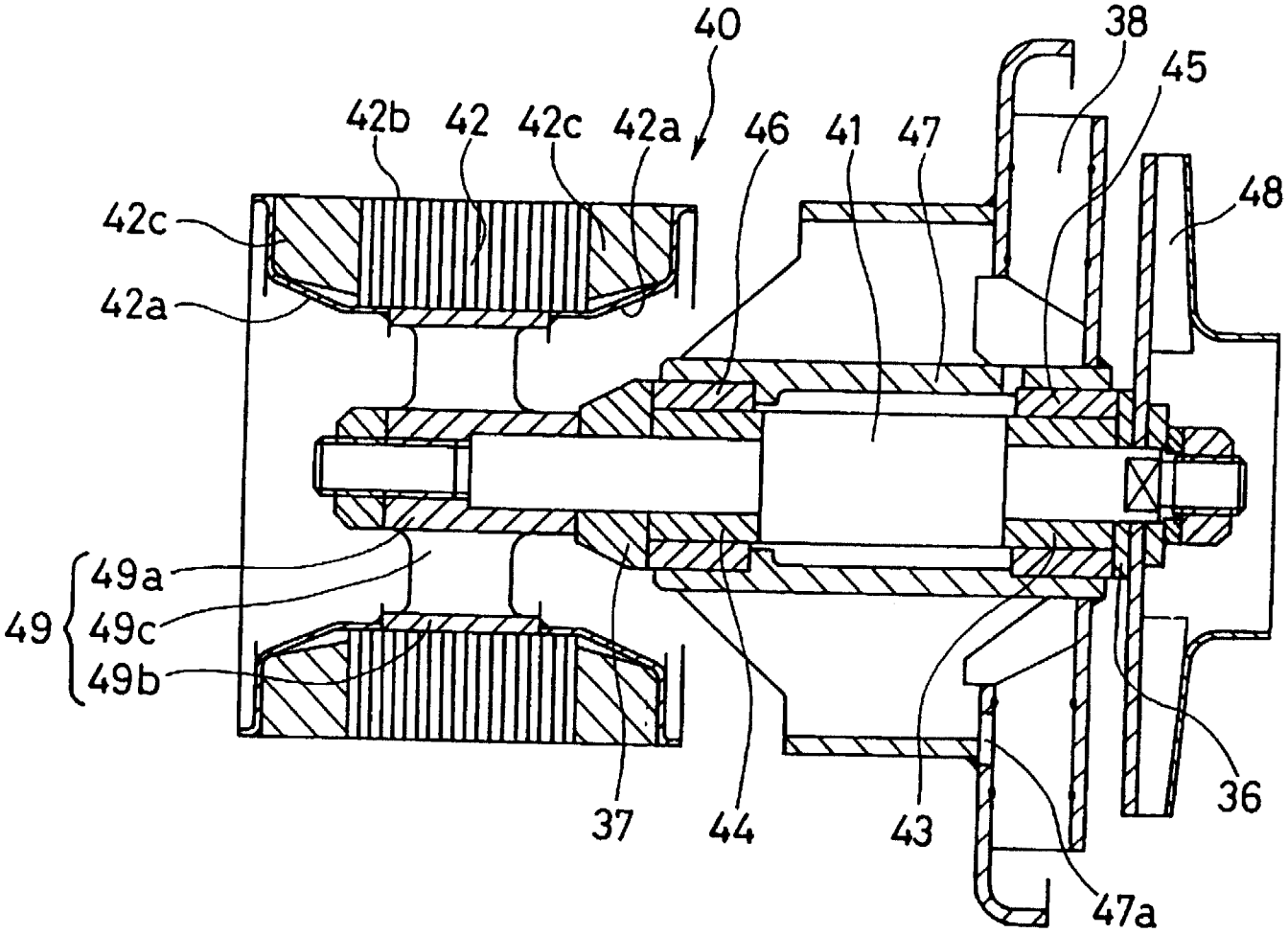
FIG. 3 is a cross-sectional view of a rotor assembly of the canned motor pump shown in FIG. 1.

As shown in FIG. 3, the rotor assembly 40 comprises a shaft 41, a rotor 42 fixedly mounted on one end of the shaft 41 by a rotor support ring 49, a pair of axially spaced plain radial bearings 45, 46 supporting the shaft 41 through respective shaft sleeves 43, 44 which are fixed to the shaft 41 and held in sliding contact with the radial bearings 45, 46, a bearing bracket 47 which holds the radial bearings 45, 46 disposed therein, and an impeller 48 fixed to the other end of the shaft 41. The bearing 46 is located closely to the rotor support ring 49. Thrust collars 36, 37 constituting thrust bearings are fixedly mounted on the shaft 41 and held in sliding contact with respective axial ends of the radial bearings 45, 46.

A return guide vane 38 is fixed to an end of the bearing bracket 47 close to the other end of the shaft 41. The bearing bracket 47 has a water drain hole **47*a* defined therein near the can holder 34. The rotor support ring 49 comprises a boss 49*a* fitted over and fixed to the shaft 41, an outer ring 49*b* held in engagement with an inner circumferential surface of the rotor 42, and a plurality of radial ribs 49*c* interconnecting the boss 49*a* and the outer rib 49*b***.

The rotor 42 is sealingly encased by can side walls **42*a* and a rotor can 42*b*. The outer ring 49*b* is sealingly welded to the can side walls 42*a* which are sealingly welded to the rotor can 42*b*. The can side walls 42*a* are tapered along inner circumferential surfaces of end rings 42*c***.

Figure 4:
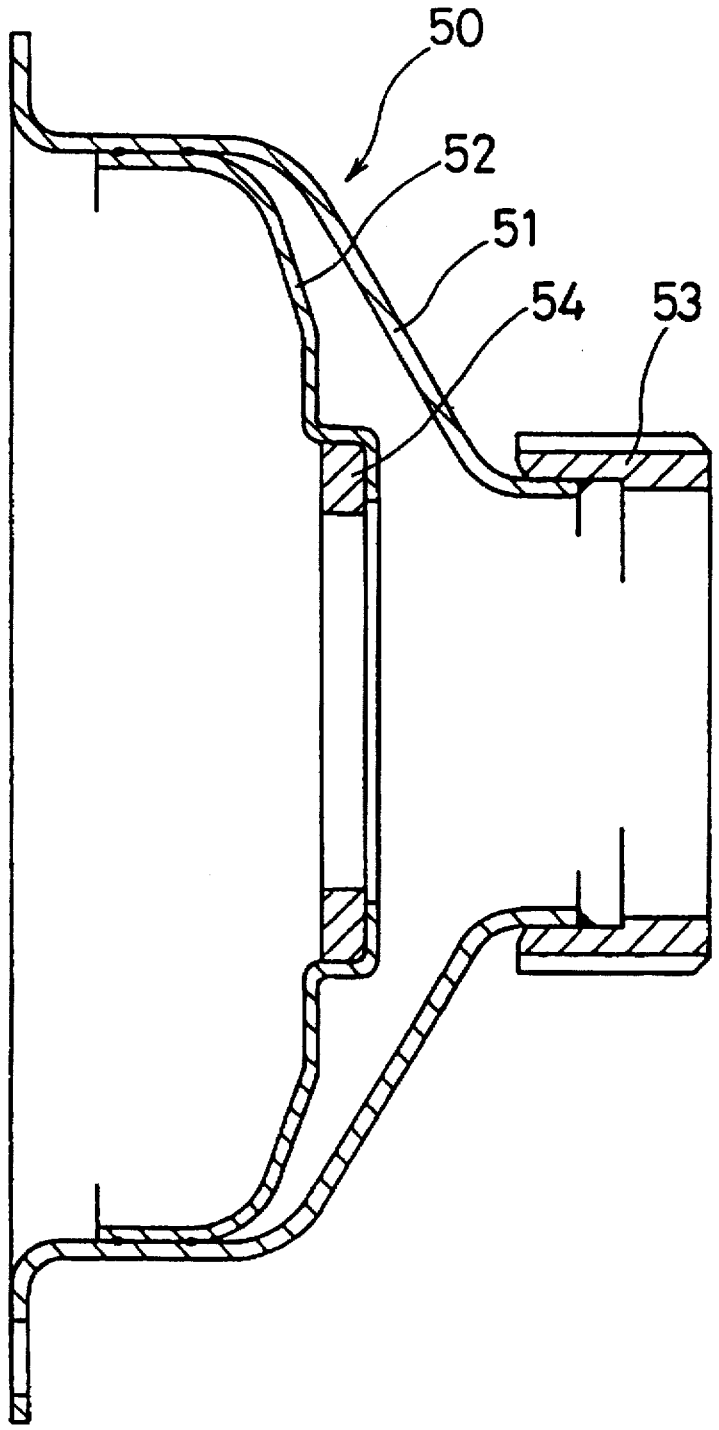
FIG. 4 is a cross-sectional view of a pump casing assembly of the canned motor pump shown in FIG. 1.

As shown in FIG. 4, the pump casing assembly 50 comprises an outer casing 51 housing the impeller 48, an inner casing 52 disposed in and welded to the outer casing 51, a nozzle ring 53 mounted on a distal end of the outer casing 51, and a liner ring 54 held by the inner casing 52.

The stator assembly 30, the rotor assembly 40, and the pump casing assembly 50 can be assembled independently of each other. As shown in FIG. 1, the stator assembly 30, the rotor assembly 40, and the pump casing assembly 50 are fastened to each other by fastening members including bolts 55, an O-ring 56, etc. When the stator assembly 30, the rotor assembly 40, and the pump casing assembly 50 are assembled, the rotor assembly 40 with the impeller 48 fixed thereto and the pump casing assembly 50 can be assembled onto the stator assembly 30 in one direction. The stator 32 has power supply cables 58 positioned closely to the pump casing assembly 50.

Figure 5:
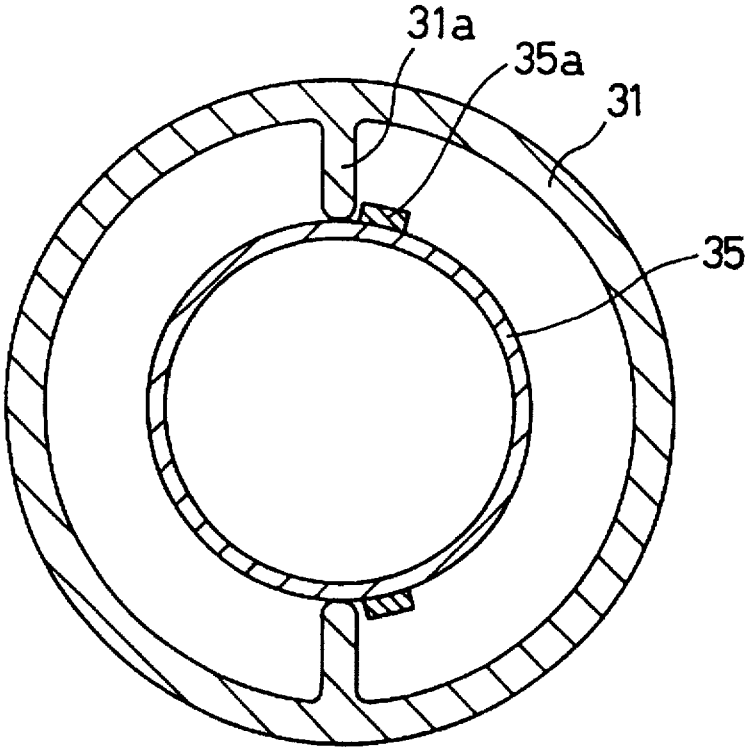
FIG. 5 is a cross-sectional view taken along line V—V of FIG. 1.

As shown in FIG. 5, the motor frame 31 has a pair of diametrically opposite ribs **31*a* projecting radially inwardly, and the nozzle 35 has a pair of stops 35*a* projecting radially outwardly for engagement with the ribs 31*a* to prevent the motor frame 31 and the nozzle 35** from rotating relatively to each other.

Figure 6:
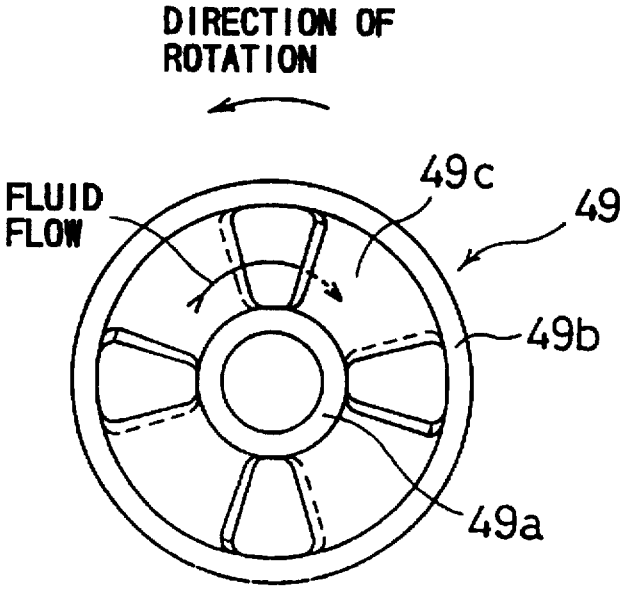
FIG. 6 is an elevational view as viewed in the direction indicated by the arrow VI in FIG. 1.

As shown in FIG. 6, the ribs **49*c* of the rotor support ring 49** are shaped as an axial-flow impeller for improving hydrodynamic efficiency.

As described above, the rotor 42 is mounted on one end of the shaft 42 and the impeller 48 on the other end thereof with the bearings 36, 37, 45, 46 positioned between the rotor 42 and the impeller 48, the radial bearings 45, 46 being supported by the single bearing bracket 47. To be more specific, all radial bearings 45, 46 and all thrust bearings 36, 37 are positioned between the connecting portion of the shaft 41 and the rotor 42, and the impeller 48. Therefore, the radial bearings 45, 46 can easily be held concentric with each other. If the axial distance between the two radial bearings 45, 46 is increased, the mechanical stability of the rotor assembly 40 is increased, i.e., any load on the bearings 45, 46 is reduced when the rotor 42 and the impeller 48 are mechanically and electrically out of balance with each other.

If the two radial bearings 45, 46 were simply spaced from each other by a desired large distance without other considerations, then the canned motor pump would be unduly large in size. In this embodiment, however, the return guide vane 38 is joined to the bearing bracket 47, the power supply cables 58 of the stator 32 are positioned closely to the pump casing assembly 50, and the bearing 46 is partly placed in the rotor 42. This arrangement minimizes any dead space in the pump while spacing the radial bearings 45, 46 largely from each other.

Figure 20:
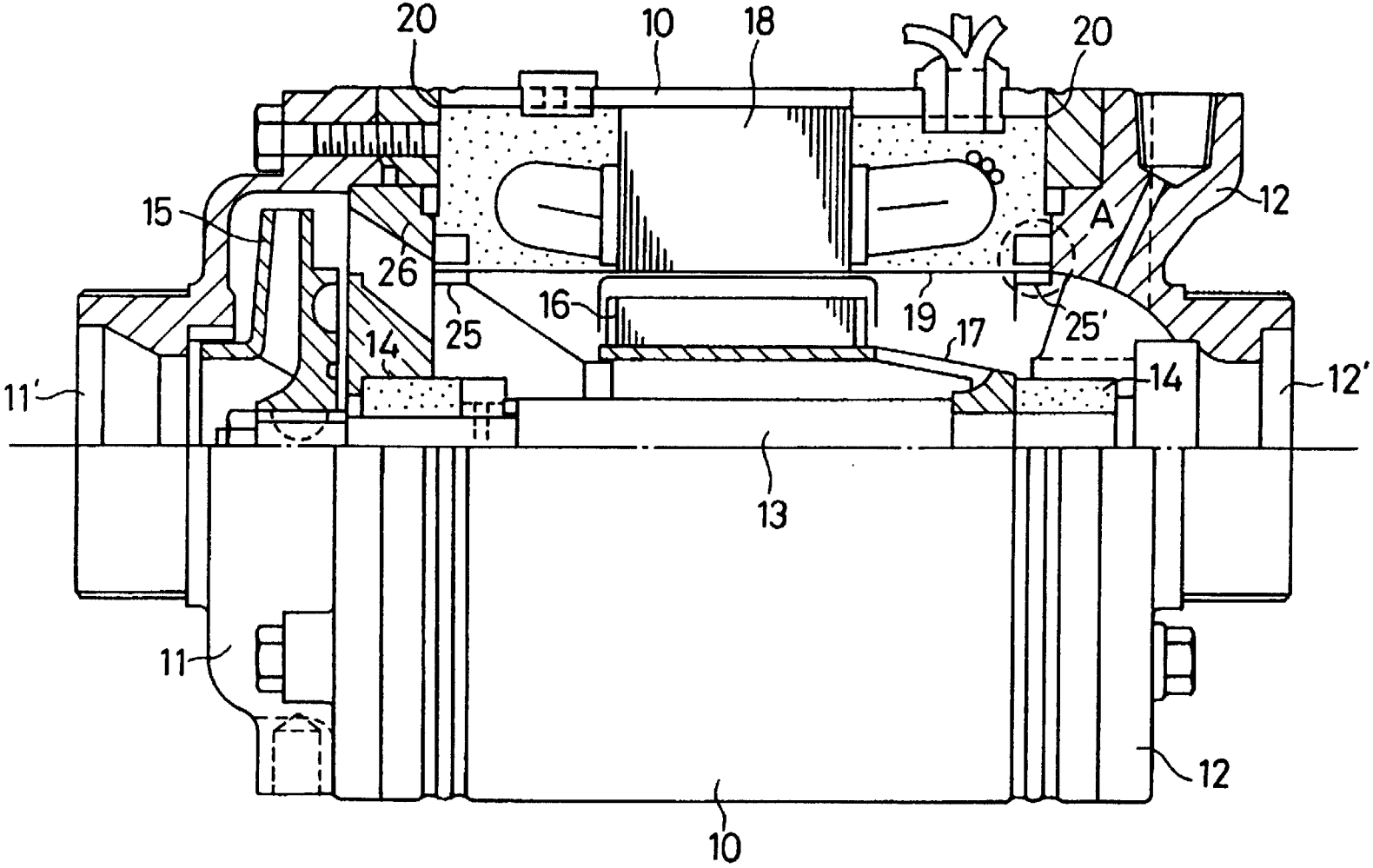
FIG. 20 PRIOR ART
FIG. 20 is a cross-sectional view of a conventional canned motor pump.
Figure 21:
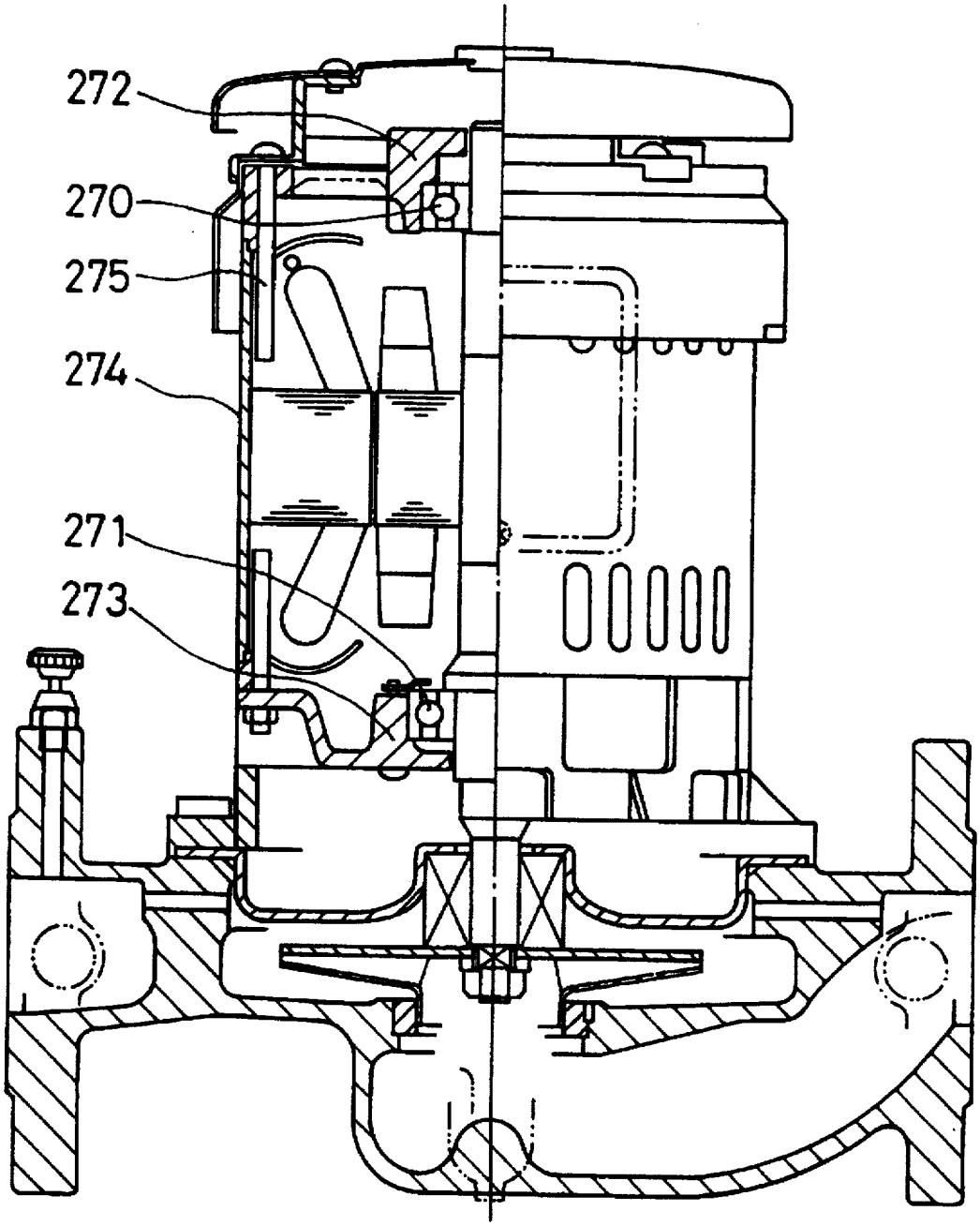
FIG. 21 PRIOR ART
FIG. 21 is a cross-sectional view of a conventional electric motor and a pump device which incorporates the electric motor.

Accordingly, the distance between the radial bearings 45, 46 can be increased without increasing an undesirable dead space in the pump. In the conventional structure shown in FIG. 20, since the bearing 14 is mounted on the side cover 12, it is impossible to guide a fluid, once collected in the axial center of the pump, from being smoothly introduced into the outlet port 12'. In the illustrated embodiment, however, the fluid collected in the axial center of the pump can be guided smoothly through the return guide vane 38 and the can side walls **42*a* into the nozzle ring 39 via the nozzle 35**, resulting in increased pump efficiency.

In this embodiment, any fluid loss in the pump is low because the outer ring **49*b* and the boss 49*a* are joined to each other by the ribs 49*c* which are in the form of an axial-flow impeller for increased efficiency particularly when the canned motor pump operates to feed the fluid at a high rate. In the conventional arrangement shown in FIG. 20, the support 17** has a fluid passage window which tends to break away the fluid at its inlet and outlet edges, producing vortexes in the fluid flow which result in a reduction in the pump efficiency.

The canned motor pump according to this embodiment is made up of the stator assembly 30, the rotor assembly 40, the pump casing assembly 50, and the fastening members including the bolts 55. Because the stator assembly 30, the rotor assembly 40, and the pump casing assembly 50 can be assembled independently of each other, the assembling process can be divided into separate processes for increased productivity. When the canned motor pump is assembled, the rotor assembly 40, the pump casing assembly 50, and the fastening members including the bolts 55 can be assembled onto the stator assembly 30. Consequently, the canned motor pump lends itself to being automatically be assembled by a robot or the like.

The outer ring **49*b* is sealingly welded to the can side walls 42*a* which are sealingly welded to the rotor can 42*b*. These members are preferably made of stainless steel sheets. As a result, the stator 32 is protected from corrosion. The tapered can side walls 42*a* extending along the inner circumferential surfaces of the end rings 42*c* make it possible to guide the fluid smoothly therealong toward the nozzle 35**.

The stator can 33 has an axial end opening toward the pump casing assembly 50, and the other axial end integrally joined to the nozzle 35 through which the fluid passes. Since only an inner surface of the nozzle 35, which is simple in shape, is exposed to the fluid in an outlet region remote from the pump casing assembly 50, only the nozzle 35 is required to be made of a corrosion-resistant material in the outlet region. In the conventional device shown in FIG. 20, the side cover 12 in its entirety is required to be made of a corrosion-resistant material, and hence is relatively expensive.

Furthermore, the motor frame 31 is of a cup shape and has a hole defined in its bottom wall in which the nozzle 35 is fitted. Since the nozzle 35 is surrounded by the motor frame 31, even when the nozzle 35 is subjected to radial external forces, they are not directly transmitted to the stator can 33, which can thus be protected from undue external forces. The motor frame 31 may be made of aluminum alloy for effectively cooling the motor because the motor frame 31 is not held in contact with the fluid handled by the canned motor pump.

The nozzle ring 39, which serves as a pipe joint, is mounted on the nozzle 35, and the motor frame 31 has an end portion that is axially gripped between the nozzle 35 and the nozzle ring 39. Accordingly, even when axial external forces are applied to the nozzle 35, the applied axial external forces are not directly transmitted to the stator can 33.

The ribs **31*a* and the stops 35*a*, which serve as a rotation prevention mechanism, are disposed between the nozzle 35 and the motor frame 31. The ribs 31*a* and the stops 35*a* are effective to prevent circumferential external forces (torsional forces) applied to the nozzle 35 from being directly transmitted to the stator can 33**.

The motor frame 31 and the nozzle 35 are joined to each other through the nozzle ring 39. If the motor frame 31 is made of a stainless steel sheet, then since the motor frame 31 and the nozzle 35 are joined to each other, the stator can 33 is protected from various external forces applied to the nozzle 35.

The water drain hole **47*a* defined in the bearing bracket 47 is commonly used as an air bleeding hole for removing air from a rotor chamber 59 when the canned motor pump is used in a horizontal attitude. With the pump casing assembly 50** having an air bleeding plug and a water drain plug, air and water can be removed from a space within the canned motor pump.

Figure 7:
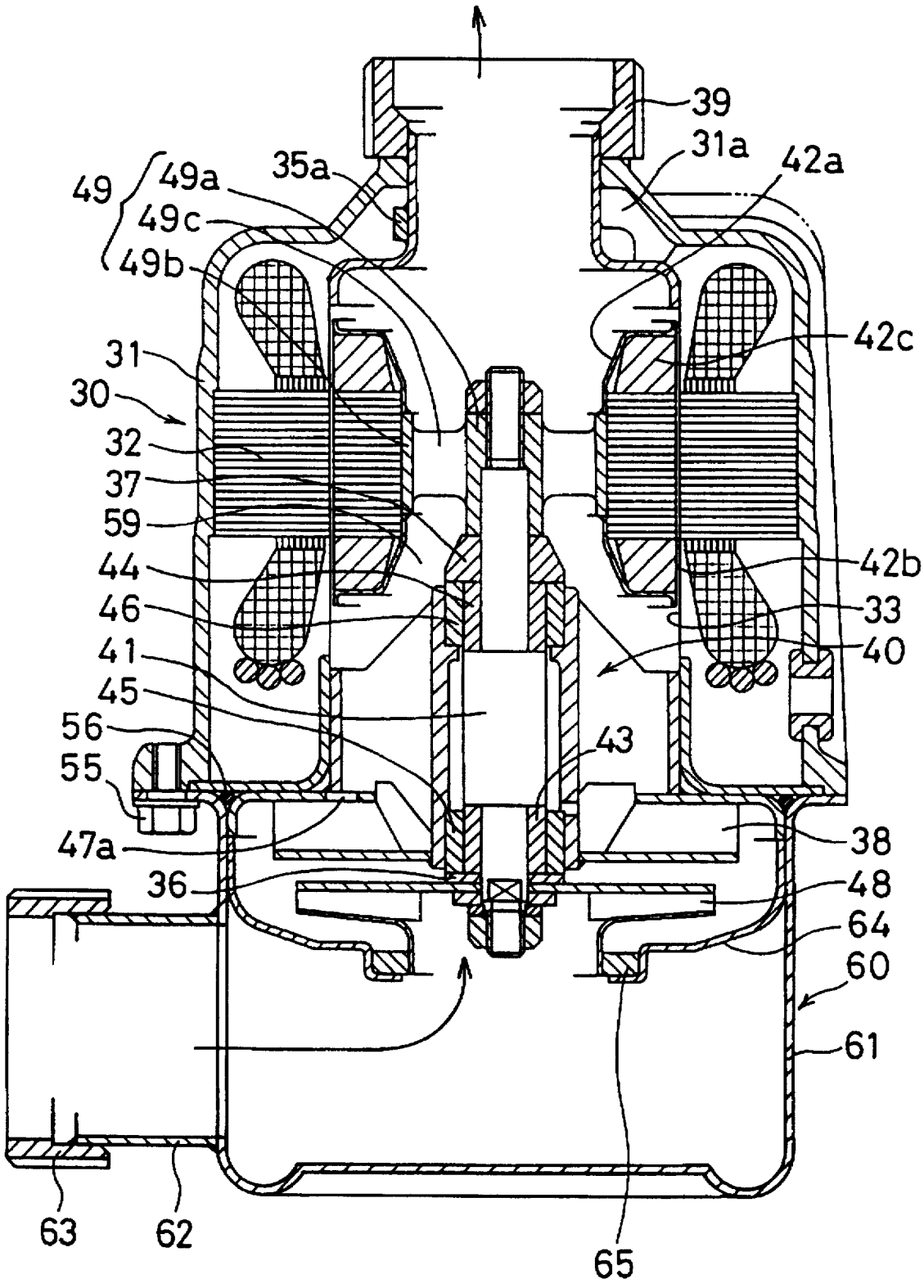
FIG. 7 is a cross-sectional view of a canned motor pump according to a second embodiment of the present invention.

FIG. 7 shows a canned motor pump according to a second embodiment of the present invention. The canned motor pump according to the second embodiment is an end-top-type pump. The canned motor pump includes a stator assembly 30, a rotor assembly 40, and a pump casing assembly 60. The stator assembly 30 and the rotor assembly 40 are identical to those shown in FIG. 1. Those parts of the stator assembly 30 and the rotor assembly 40 which are identical to those shown in FIG. 1 are denoted by identical reference characters, and will not be described in detail below. The pump casing assembly 60 comprises a cup-shaped outer casing 61 with no opening or hole in its bottom wall, a nozzle 62 and a nozzle ring 63 which are mounted on a cylindrical side wall of the outer casing 61, an inner casing 64 disposed in and welded to the outer casing 61, and a liner ring 65 held by the inner casing 64. The bottom wall of the outer casing 61 serves to be placed on an installation surface of a base (not shown).

In the second embodiment, a fluid drawn in from the nozzle 62 enters the outer casing 61 and changes its direction upwardly through 90° so as to be directed toward the impeller 48. The fluid is then discharged by the impeller 48 and collected in the axial pump center by the return guide vane 38. Thereafter, the fluid is guided by the can side walls **42*a* to flow toward the nozzle 35**, from which the fluid is discharged.

Figure 8:
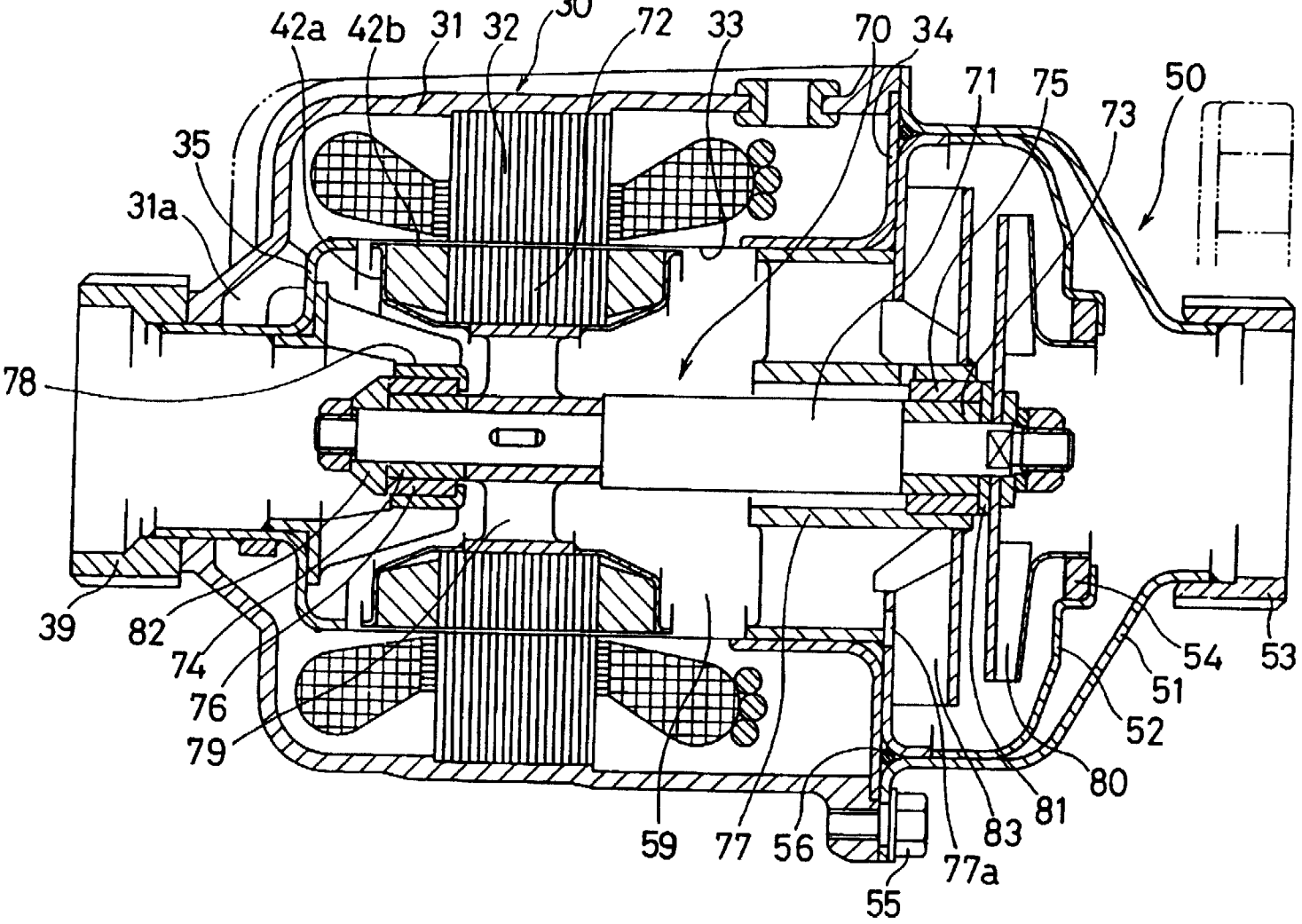
FIG. 8 is a cross-sectional view of a canned motor pump according to a third embodiment of the present invention.

FIG. 8 shows a canned motor pump according to a third embodiment of the present invention. The canned motor pump according to the third embodiment is an in-line-type pump, and differs from the canned motor pump shown in FIG. 1 only with respect to a rotor assembly 70. As illustrated in FIG. 8, the rotor assembly 70 comprises a shaft 71, a rotor 72 fixedly mounted on one end of the shaft 71 by a rotor support ring 79, a pair of axially spaced plain radial bearings 75, 76 supporting the shaft 71 through respective shaft sleeves 73, 74 which are fixed to the shaft 71 and held in sliding contact with the radial bearings 75, 76, a pair of bearing brackets 77, 78 which hold the respective radial bearings 75, 76 disposed therein, and an impeller 80 fixed to the other end of the shaft 71. The bearing 76 is located closely to the rotor support ring 79. Thrust collars 81, 82 constituting thrust bearings are fixedly mounted on the shaft 71 and held in sliding contact with respective axial ends of the radial bearings 75, 76.

A return guide vane 83 is fixed to an end of the bearing bracket 77 close to the other end of the shaft 71. The bearing bracket 77 has a water drain hole 77*a* defined therein near the can holder 34.

The canned motor pump shown in FIG. 8 also has a stator assembly 30 and a pump casing assembly 50 which are identical to those shown in FIG. 1. Those parts of the stator assembly 30 and the pump casing assembly 50 which are identical to those shown in FIG. 1 are denoted by identical reference characters, and will not be described in detail below.

To assemble the stator assembly 30, the rotor assembly 40, and the pump casing assembly 50, the rotor assembly 40 and the pump casing assembly 50 are assembled onto the stator assembly 30 in one direction, and finally the bearing bracket 78 is welded to the nozzle 35.

In the third embodiment, since the two radial bearings 75, 76 are supported by the respective bearing brackets 77, 78 without all radial bearings positioned between the rotor 72 and the impeller 80, it is somewhat difficult to keep the radial bearings 75, 76 concentric with each other.

Figure 9:
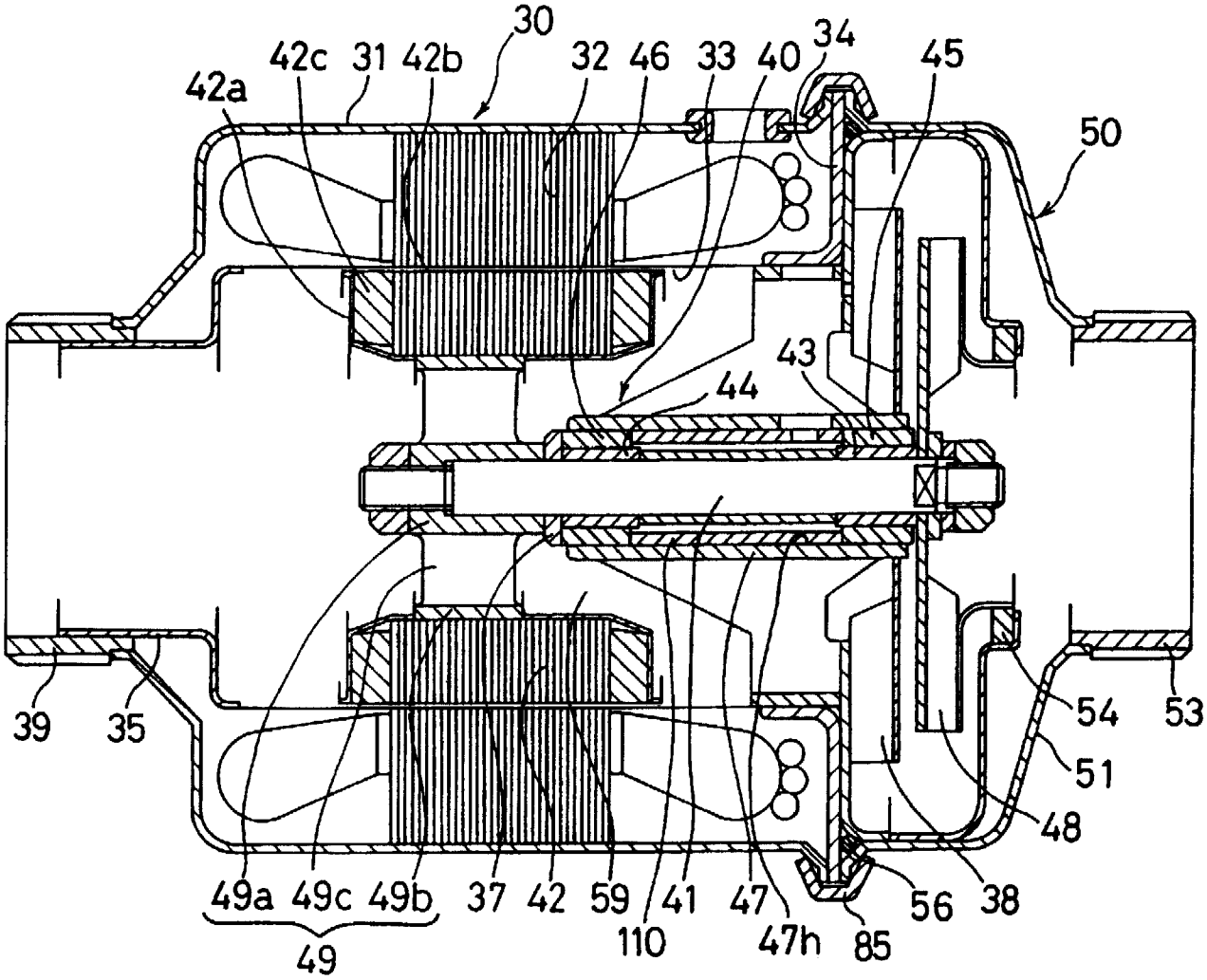
FIG. 9 is a cross-sectional view of a canned motor pump according to a fourth embodiment of the present invention.

FIG. 9 shows a canned motor pump according to a fourth embodiment of the present invention. The canned motor pump according to the fourth embodiment is an in-line-type pump. As shown in FIG. 9, the canned motor pump includes a stator assembly 30, a rotor assembly 40, and a pump casing assembly 50 which are substantially the same as those of the canned motor pump shown in FIG. 1.

The stator assembly 30 and the pump casing assembly 50 are connected to each other by a fastening band 85 which grips mating axial ends of the motor frame 31 and the outer casing 51 with the can holder 34 interposed therebetween. The motor frame 31 and the nozzle 35 are joined to each other through the nozzle ring 39. In this embodiment, the bearing bracket 47 has a housing 47*h* having an inside diameter equal to the outside diameter of the radial bearings 45, 46, which comprise plain bearings of ceramics. An axial distance piece or spacer 110 is disposed around the shaft 41 in the housing 47*h* between the radial bearings 45, 46 to keep the radial bearings 45, 46 spaced axially from each other by a desired axial distance.

In the fourth embodiment, the housing 47*h* of the bearing bracket 47 is free of concentricity errors, i.e., remains accurately concentric throughout its length, because it can be machined in one axial direction. Specifically, inasmuch as the housing 47*h* does not need to be machined in two opposite directions in two steps, the axial ends of the housing 47*h* are held concentric with each other. As a result, the housing 47*h* and hence the bearing bracket 47 do not cause sliding surfaces of the radial bearings 45, 46 to suffer localized abutment against each other. Therefore, the radial bearings 45, 46 made of a hard ceramic material such as SiC are protected from cracks which would otherwise occur if their sliding surfaces were subjected to localized abutment against each other.

Motor pumps with cantilevered shafts tend to suffer radial shaft displacements due to concentricity errors on account of a short span or distance between the bearings. When the shaft 41 undergoes such a radial shaft displacement in this embodiment, the rotor 42 may be brought into contact with the stator 32, resulting in fatal damage to the pump. The axial spacer 110 is, however, effective to keep a desired axial distance between the radial bearings 45, 46 on the cantilevered shaft 41, thus preventing the rotor 42 from contacting the stator 32.

Figure 10:
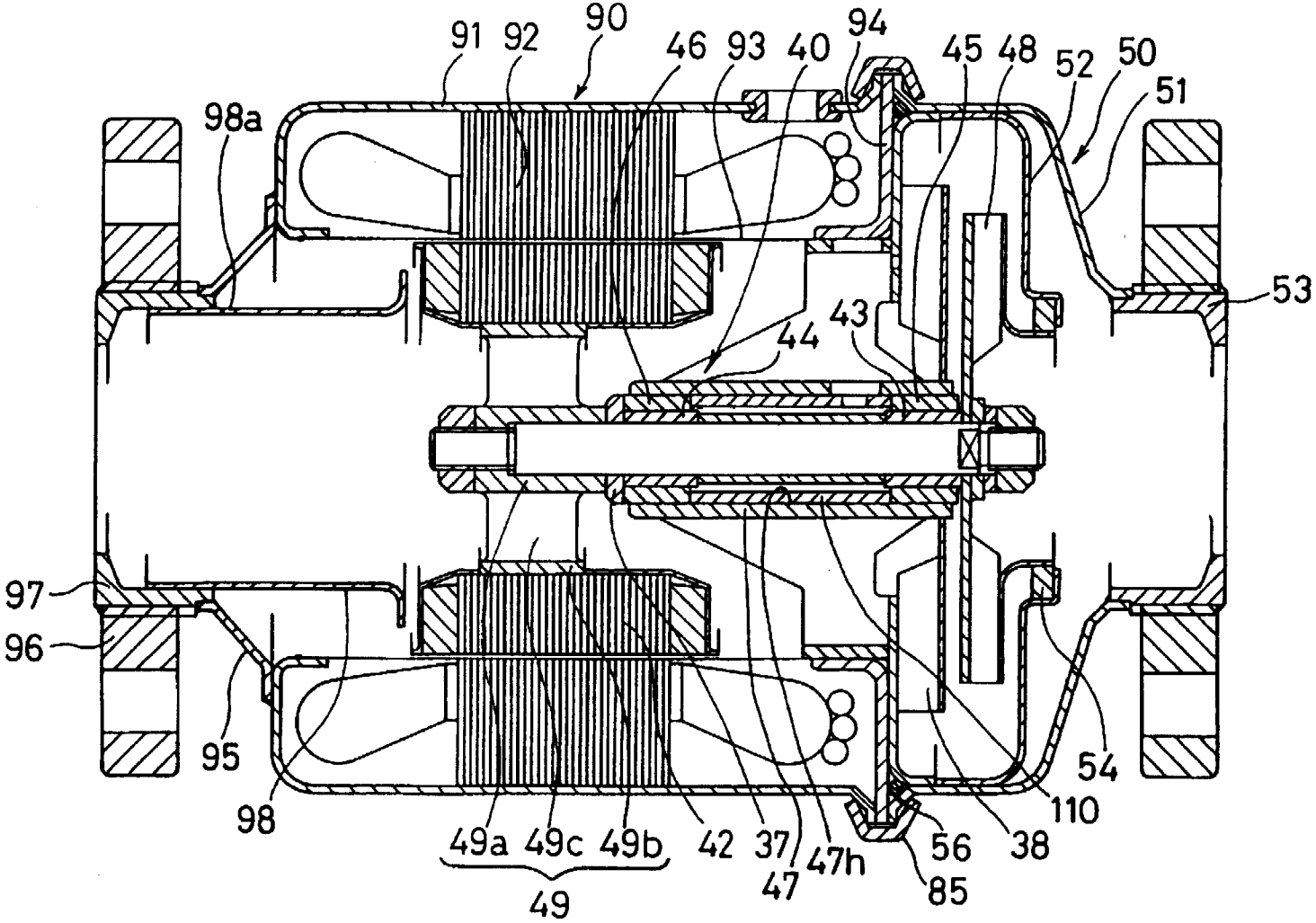
FIG. 10 is a cross-sectional view of a canned motor pump according to a fifth embodiment of the present invention.

FIG. 10 shows a canned motor pump according to a fifth embodiment of the present invention. The canned motor pump according to the fifth embodiment is an in-line-type pump. As shown in FIG. 10, the canned motor pump includes a rotor assembly 40 and a pump casing assembly 50 which are substantially the same as those of the canned motor pump shown in FIG. 1. The canned motor pump also includes a bearing bracket 47 and a distance piece 110 which are identical to those shown in FIG. 9.

The canned motor pump shown in FIG. 10 also includes a stator assembly 90 comprising a motor frame 91 made of a sheet metal, a stator 92 disposed in the motor frame 91, a stator can 93 positioned radially inwardly of the motor frame 91 and the stator 92, a can holder 94 joined to one axial side of the stator can 93 for holding the stator can 93 in the motor frame 91, and a nozzle 95 connected to one end of the motor frame 91. A nozzle ring 97 with a flange 96 supported radially outwardly thereon is fixed to the nozzle 95. A cylindrical mouth 98 is fixed to the nozzle ring 97 and disposed radially inwardly of the nozzle 95 and the stator can 93. The cylindrical mouth 98 has a hole 98*a* defined in its cylindrical wall radially inwardly of the nozzle 95.

The stator assembly 90 and the pump casing assembly 50 are connected to each other by a fastening band 85 which grips mating axial ends of the motor frame 91 and the outer casing 51 with the can holder 94 interposed therebetween.

In the fifth embodiment, the stator can 93 has an axial end opening toward the pump casing assembly 50, and the other axial end joined to the motor frame 91 to which the nozzle 95 is joined. If the motor frame 91 is made of a stainless steel sheet, then since the stator can 93 is joined to the motor frame 91 and the nozzle 95 is joined to the motor frame 91, the stator can 93 is protected from various external forces that are applied to the nozzle 95.

Figure 11:
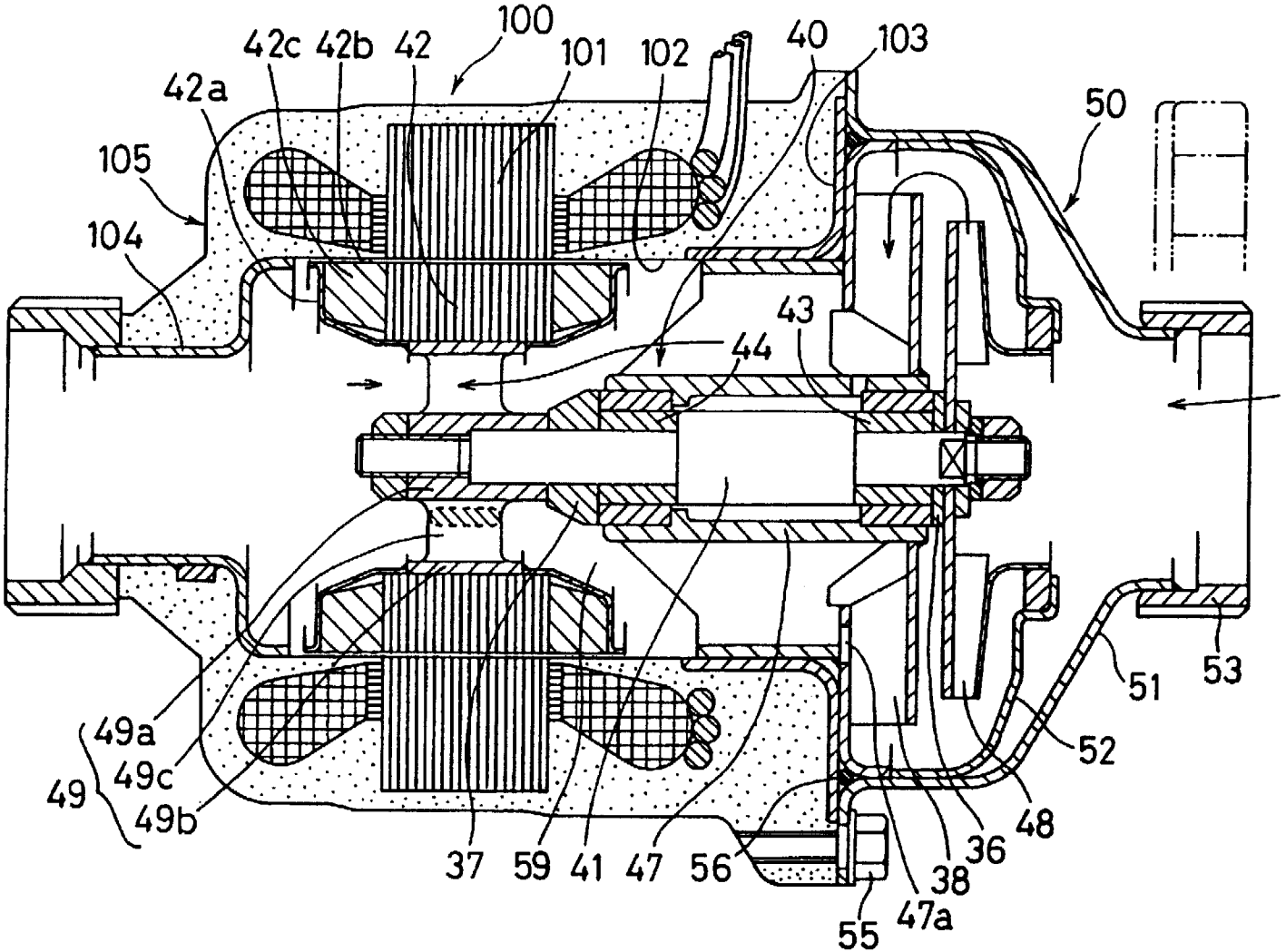
FIG. 11 is a cross-sectional view of a canned motor pump according to a sixth embodiment of the present invention.

FIG. 11 shows a canned motor pump according to a sixth embodiment of the present invention. The canned motor pump according to the sixth embodiment is an in-line-type pump. As shown in FIG. 11, the canned motor pump includes a rotor assembly 40 and a pump casing assembly 50 which are substantially the same as those of the canned motor pump shown in FIG. 1.

The canned motor pump shown in FIG. 11 also includes a stator assembly 100 comprising a stator 101, a stator can 102 positioned radially inwardly of the stator 101, a can holder 103 joined to one axial end of the stator can 102 for holding the stator can 102 in position, and a nozzle 104 connected to the other axial side of the stator can 102. The stator 101 in its entirety is encased in a molded mass 105 of synthetic resin. The other details of the canned motor pump shown in FIG. 11 are identical to those shown in FIG. 1.

Figure 12:
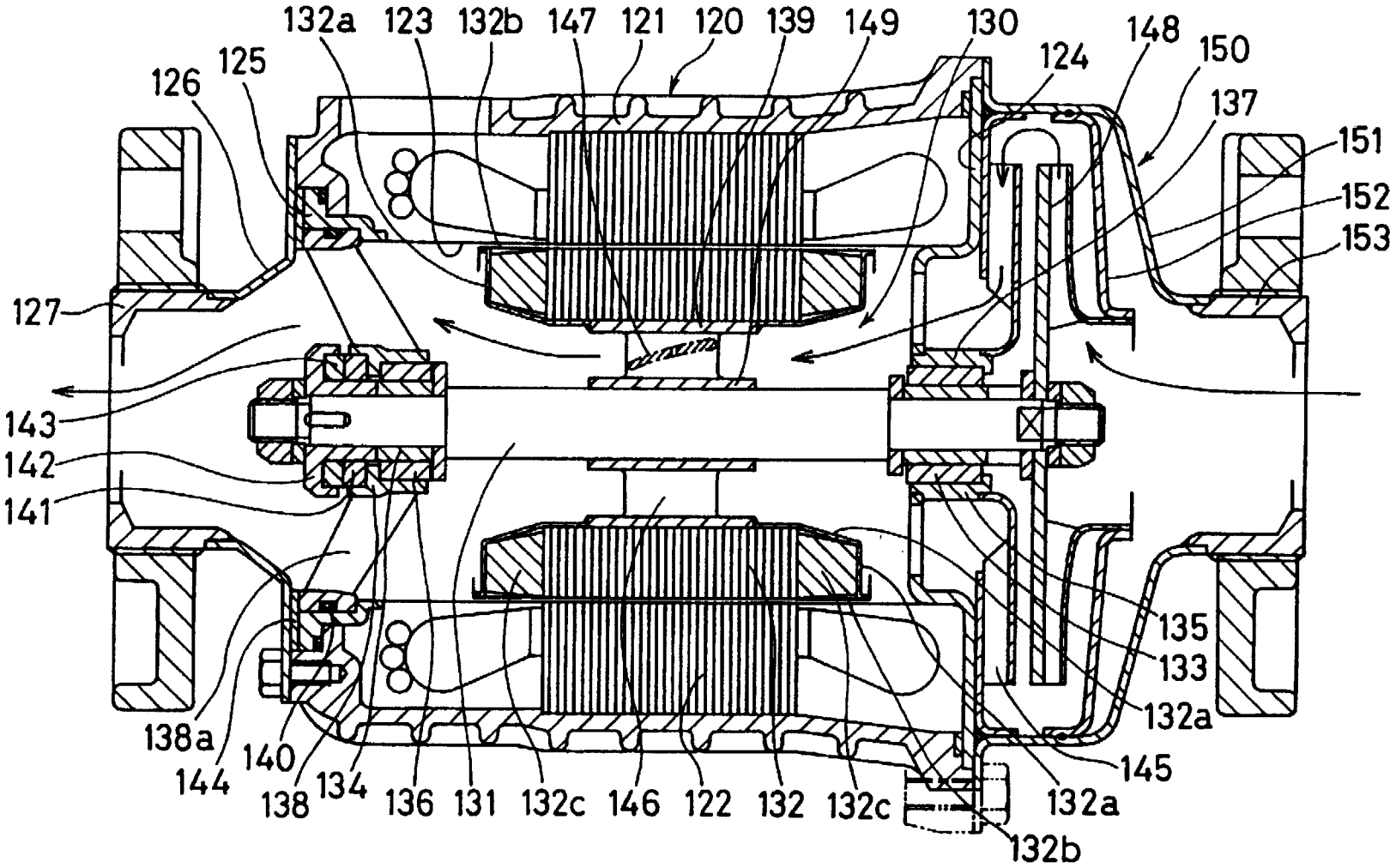
FIG. 12 is a cross-sectional view of a canned motor pump according to a seventh embodiment of the present invention.

FIG. 12 shows a canned motor pump according to a seventh embodiment of the present invention. The canned motor pump according to the seventh embodiment is an in-line-type pump. As shown in FIG. 12, the canned motor pump comprises a stator assembly 120, a rotor assembly 130, a pump casing assembly 150, and fastening members including bolts, gaskets, etc.

The stator assembly 120 comprises a cup-shaped motor frame 121 molded of synthetic resin, a stator 122 fixedly disposed in the cup-shaped motor frame 121, a stator can 123 disposed in the stator 122 radially inwardly of the stator 122, a can holder 124 joined to one axial side of the stator can 123 for holding the stator can 123 in the motor frame 121, a nozzle 126 connected to one end of the motor frame 121, and a nozzle ring 127 mounted on the distal end of the nozzle 126.

The rotor assembly 130 comprises a shaft 131, a rotor 132 fixedly mounted on the shaft 131 by a rotor support ring 139, a pair of axially spaced plain radial bearings 135, 136 supporting the shaft 131 near its opposite ends through respective shaft sleeves 133, 134 which are fixed to the shaft 131 and held in sliding contact with the radial bearings 135, 136, a pair of bearing brackets 137, 138 which holds the respective bearings 135, 136 disposed therein, and an impeller 148 fixed to one of the ends of the shaft 131. The bearing bracket 138 is fitted in the can holder 125 with a resilient member 140 interposed therebetween.

The bearing bracket 138 holds the radial bearing 136 and a fixed thrust bearing 141 at the other end of the shaft 131 near the nozzle 126. A thrust disk 142 is fixedly mounted on the end of the shaft 131 and supports a rotary thrust bearing 143 which is held in sliding contact with the fixed thrust bearing 141. The bearing bracket 138 is pressed against the nozzle 126 through a gasket 144 interposed therebetween.

The bearing bracket 137 is connected to the can holder 124 and a return guide vane 145 which is also joined to the can holder 124. The rotor support ring 139 is connected by radial ribs 146 to a boss 149 which is fixedly fitted over the shaft 131. The ribs 146 are shaped as an axial-flow impeller 147. The rotor 132 is sealingly encased by can side walls **132*a* and a rotor can 132*b*. The rotor support ring 139 is sealingly welded to the can side walls 132*a* which are sealingly welded to the rotor can 132*b*. The can side walls 132*a* are tapered along inner circumferential surfaces of end rings 132*c***.

The pump casing assembly 150 comprises an outer casing 151 housing the impeller 148, an inner casing 152 disposed in and welded to the outer casing 151, and a nozzle ring 153 mounted on a distal end of the outer casing 151.

In this embodiment, the rotor support ring 139 and the boss 149 are radially connected to each other by the ribs 146 which are shaped as the axial-flow impeller 147 for reducing a fluid loss radially inwardly of the rotor 132. The axial-flow impeller 147 and the impeller 148 jointly provide a multistage pump for producing a high pump head which can be achieved without increasing the outside diameter of the impeller 148. Accordingly, the canned motor pump may be reduced in size.

The can side walls **132*a* are tapered for smoothly guiding the fluid flow through the pump. Therefore, the fluid discharged from the impeller 148 is guided smoothly toward the axial-flow impeller 147 composed of the ribs 146, and the fluid discharged from the axial-flow impeller 147 is guided smoothly toward the nozzle 126. Any fluid loss caused by the ribs 146** is therefore small, and hence the pump has high efficiency.

The bearing bracket 138 also has a plurality of radial ribs **138*a* shaped to guide the fluid therethrough. While the fluid discharged from the axial-flow impeller 147 tends to flow as a swirling stream, any unwanted swirling motion of the fluid is limited by the ribs 138*a* of the bearing bracket 138**, resulting in high pump efficiency.

Figure 13:
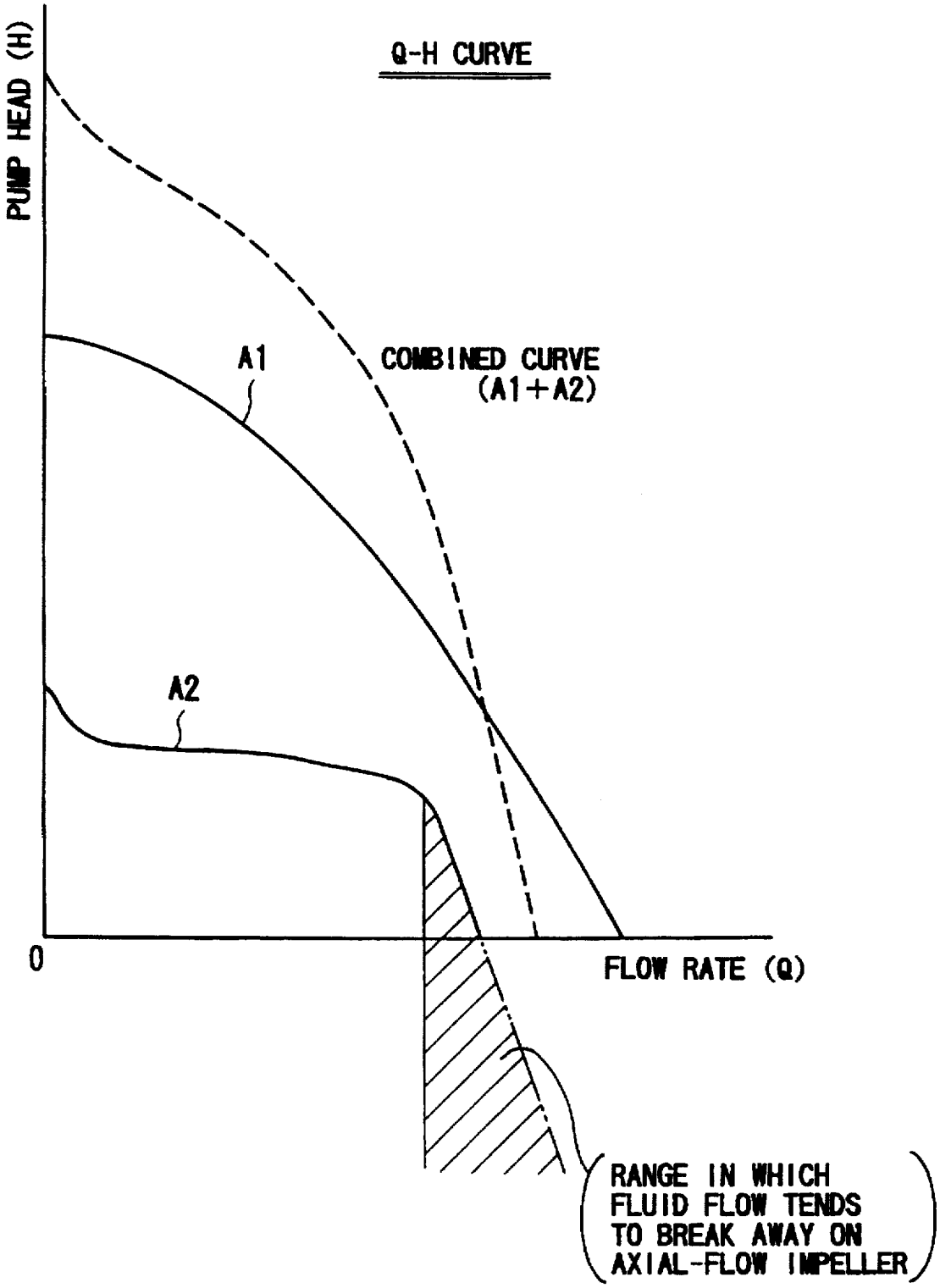
FIG. 13 is a diagram showing the Q-H characteristics of the canned motor pump according to the seventh embodiment of the present invention.

As shown in FIG. 13, the Q-H characteristic curve of the canned motor pump shown in FIG. 12 is a combination of a flow rate curve A1 produced by the centrifugal vanes of the impeller 148 and a flow rate curve A2 produced by the axial vanes of the axial-flow impeller 147, the flow rate curve A2 being on a lower flow rate side than the flow rate curve A1. Generally, the operating point of a circulating pump varies due to aging of the piping system such as corrosion and incrustation, and the pump is required to have a small change in the flow rate in response to a change in the pump head, i.e., to have a steeper Q-H characteristic curve. The combined Q-H characteristic curve of the canned motor pump is made steeper because the flow rate curve A2 is on a lower flow rate side than the flow rate curve A1, as shown in FIG. 13.

Figure 14:
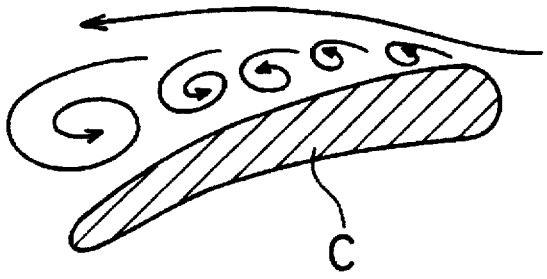
FIG. 14 is a cross-sectional view showing a fluid flow along a conventional axial-flow impeller vane.

FIG. 14 shows a fluid flow along a conventional axial-flow impeller vane C. As shown in FIG. 14, when the fluid flows at a high rate, the fluid flow tends to be broken away or separated from the vane C, causing noise.

Figure 15:
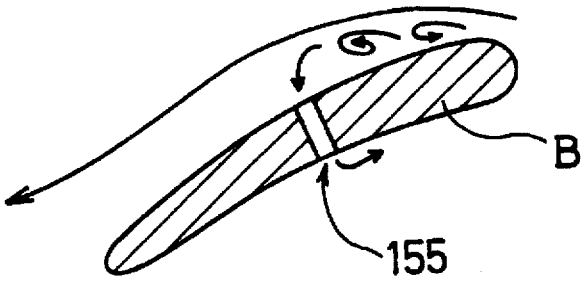
FIG. 15 is a cross-sectional view showing a fluid flow along an axial-flow impeller vane according to the present invention.

FIG. 15 shows a fluid flow along an axial-flow impeller vane B according to the present invention. The impeller vane B has a through hole 155 defined therein for preventing the fluid flow from being broken away or separated from the vane B.

Figure 16:
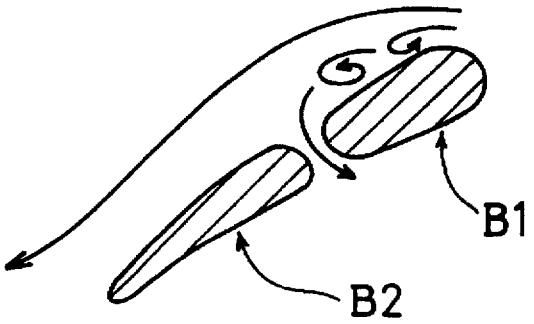
FIG. 16 is a cross-sectional view showing a fluid flow along another axial-flow impeller vane according to the present invention.

FIG. 16 shows a fluid flow along another axial-flow impeller vane according to the present invention. The axial-flow impeller vane is divided into vane segments B1, B2 spaced from each other for preventing the fluid flow from being broken away or separated from the vane B.

Figure 17:
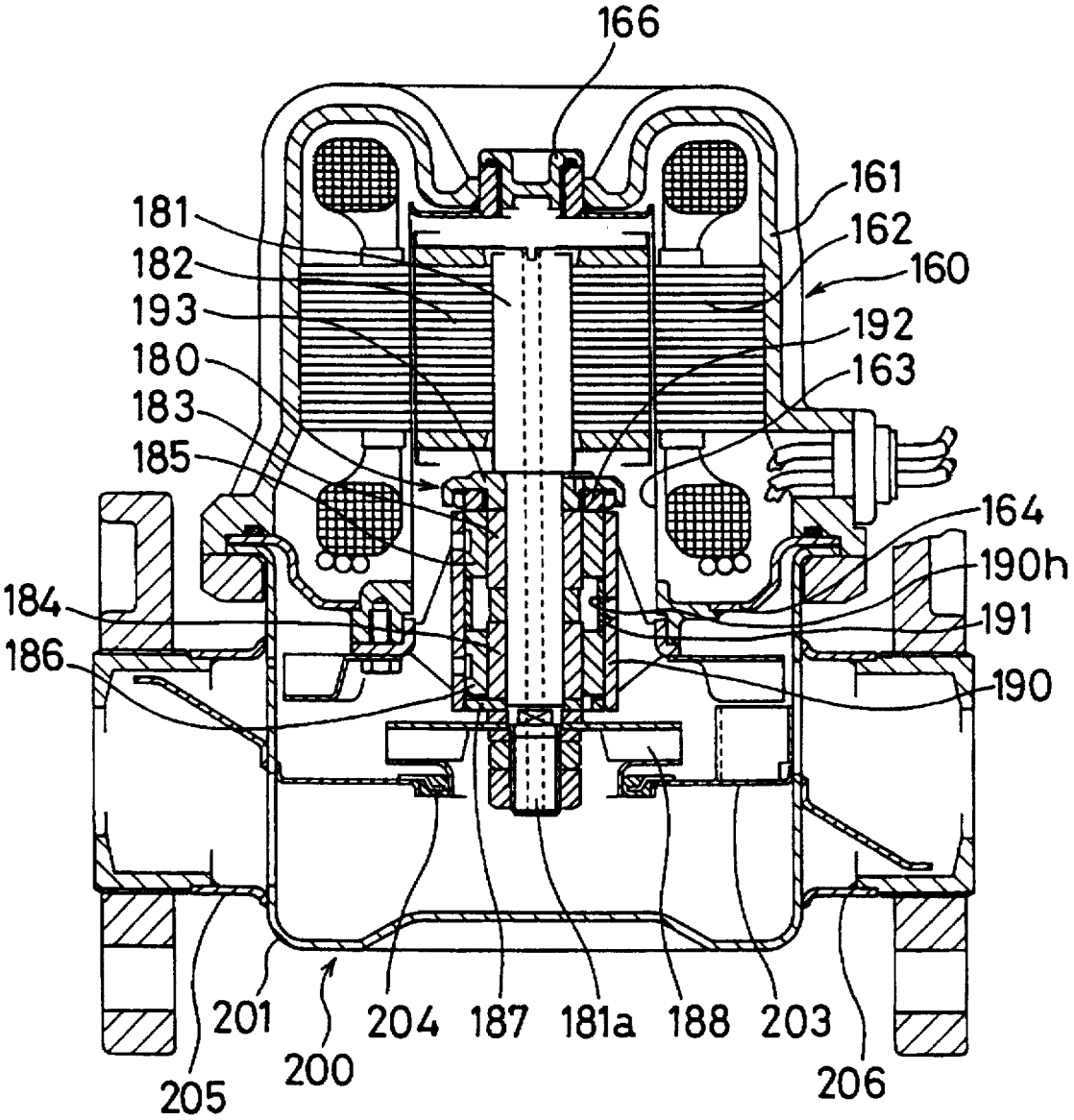
FIG. 17 is a cross-sectional view of a canned motor pump according to an eighth embodiment of the present invention.

FIG. 17 shows in cross section the canned motor pump according to the eighth embodiment of the present invention. The canned motor pump shown in FIG. 17 is in the form of an in-line-type pump comprising a stator assembly 160, a rotor assembly 180, a pump casing assembly 200, and fastening members including bolts, gaskets, etc.

As shown in FIG. 17, the stator assembly 160 comprises a cup-shaped motor frame 161, a stator 162 fixedly disposed in the cup-shaped motor frame 161, a stator can 163 disposed in the stator 162 radially inwardly of the stator 162, a can holder 164 joined to one axial side of the stator can 163 for holding the stator can 163 in the motor frame 161. On the upper portion of the motor frame 161, there is provided a cap 166 for bleeding air and confirming manual rotation of the rotor assembly 180.

The rotor assembly 180 comprises a shaft 181, a rotor 182 fixedly mounted on the shaft 181, a pair of axially spaced plain radial bearings 185, 186 supporting the shaft 181 through respective shaft sleeves 183, 184 which are fixed to the shaft 181 and held in sliding contact with the bearings 185, 186, a bearing bracket 190 which holds the bearings 185, 186 disposed therein, and an impeller 188 fixed to one end **181*a* of the shaft 181. A thrust collar 187 is fixedly mounted on the shaft 181 and held in contact with an axial end of the radial bearing 186, and a thrust disk 193 supporting a thrust bearing 192 is fixedly mounted on the shaft 181 and held in contact with an axial end of the radial bearing 185**.

The bearing bracket 190 has a housing **190*h* having an inside diameter equal to the outside diameter of the radial bearings 185, 186, which comprise plain bearings of ceramics. An axial distance piece or spacer 191 is disposed around the shaft 181 in the housing 190*h* between the radial bearings 185, 186 to keep the radial bearings 185, 186** spaced axially from each other by a desired axial distance.

The pump casing assembly 200 comprises a pump casing 201 housing the impeller 188, a partition 203 disposed in the pump casing 201, and a liner ring 204 held by the partition 203. A suction nozzle 205 and a discharge nozzle 206 are fixed to the pump casing 201.

This embodiment has the same effect as that of the embodiments of FIGS. 9 and 10 by providing the distance piece for keeping desired axial distance between the radial bearings. Further, in this embodiment, since the liquid flows from a side of the motor which is close to the impeller to a side thereof which is remote from the impeller, the various parts of the motor can be cooled under uniform conditions.

Figure 18:
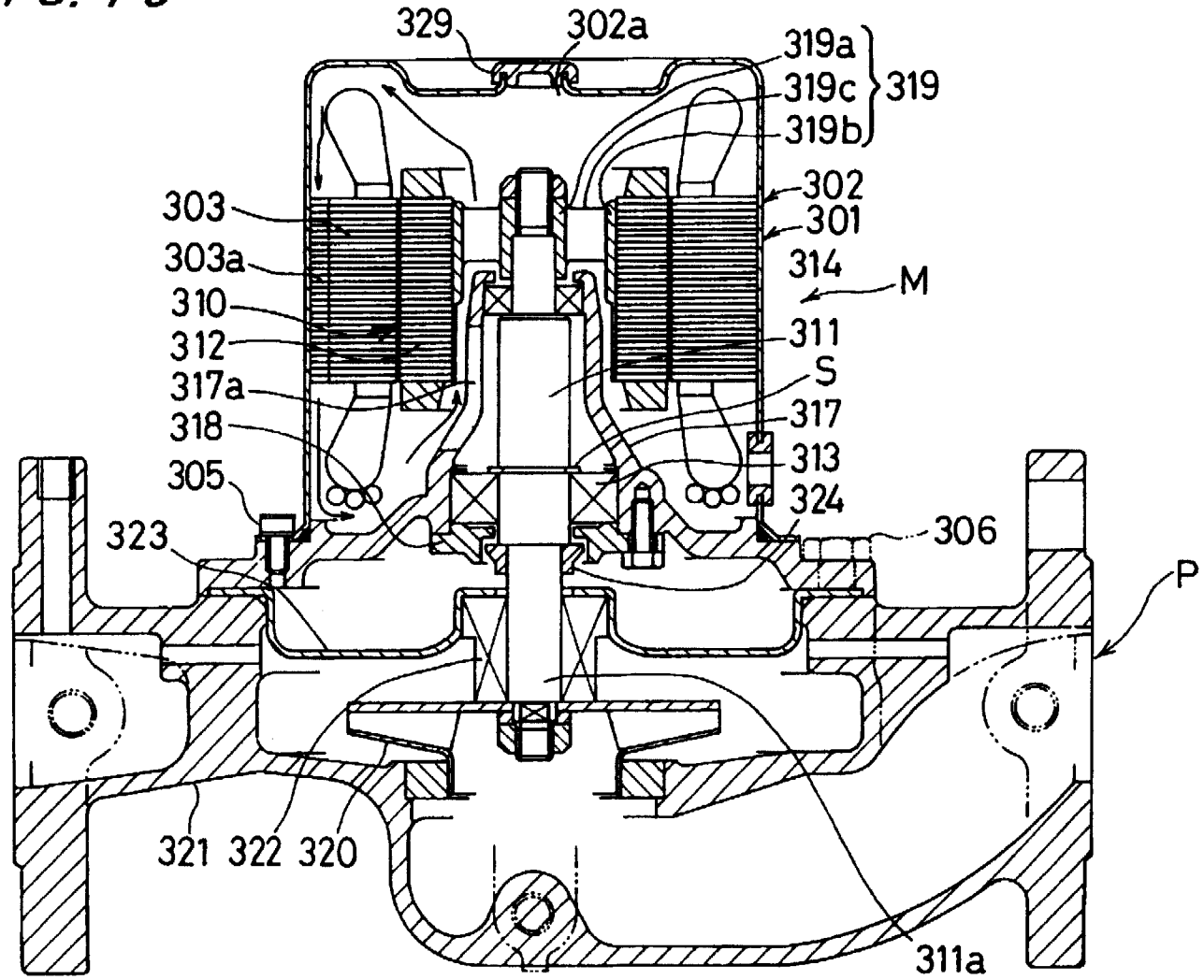
FIG. 18 is a cross-sectional view of an electric motor with cantilever bearings and a pump device which incorporates the electric motor, according to a ninth embodiment of the present invention.

FIG. 18 shows in cross-section an electric motor M with cantilever bearings according to the ninth embodiment of the present invention which is combined with a line-type pump P. In this embodiment, the motor M is not composed of a canned motor. The electric motor M comprises a stator assembly 301, a rotor assembly 310, and fastening members including bolts, gaskets, etc.

The stator assembly 301 comprises a cup-shaped motor frame 302 and a stator 303 fixedly disposed in the cup-shaped motor frame 302.

The rotor assembly 310 comprises a shaft 311, a rotor 312 fixedly mounted on one end of the shaft 311 by a rotor support ring 319, a pair of axially spaced plain bearings 313, 314 supporting the shaft 311, a bearing bracket 317 which holds the bearings 313, 314 disposed therein, and a bearing cover 318 closing an open end of the bearing bracket 317 disposed remotely from the rotor 312. The bearing 314 is located closely to the rotor support ring 319. The motor frame 302 is fastened to the bearing bracket 317 by bolts 305. The bearing bracket 317 has a window opening 317*a* defined in a side wall thereof. A snap ring S is mounted on the main shaft 311 against the bearing 313.

The shaft 311 has another end 311*a* opposite to the end thereof which supports the rotor 312, the end 311*a* serving as a coupling for transmitting motor power. The pump P includes an impeller 320 which is fixed to the end 311*a*.

The rotor support ring 319 comprises a boss 319*a* fitted over and fixed to the shaft 311, an outer ring 319*b* held in engagement with an inner circumferential surface of the rotor 312, and ribs 319*c* interconnecting the boss 319*a* and the outer rib 319*b*. The ribs 319*c* are shaped as an impeller for producing an axial flow of air.

The electric motor M and the pump P jointly make up a line-type pump device. The pump P comprises the impeller 320, a pump casing 321 housing the impeller 320, a mechanical seal 322 disposed on the shaft 311 behind the impeller 320, and a mechanical seal cover 323 covering the mechanical seal 322. The electric motor M is detachably fastened to the pump P by bolts 306. A water stop flange 324 is mounted on the shaft 311 between the bearing cover 318 and the mechanical seal cover 323.

In the electric motor M, the two bearings 313, 314 are fixedly housed in the bearing bracket 317 which is fixed to the motor frame 302 closely to the end 311*a* as the coupling. The bearing bracket 317 is preferably in the form of a casting so that it will not vibrate easily.

Since the regions which support the bearings 313, 314 are machined on the same bearing bracket 317, the bearings 313, 314 are held concentrically with each other highly accurately. Because the motor frame 302 is not required to securely support the bearings 313, 314, the motor frame 302 can be pressed from a relatively thin sheet metal into a cup shape, and hence the productivity of the motor frame 302 is increased. The electric motor M requires no upper bearing bracket.

If the bearings 313, 314 were positioned closely to one end of the shaft 311, the spacing between the bearings 313, 314 would be reduced, thus causing a large load to be imposed on the bearings 313, 314 and also causing the shaft 311 to vibrate easily. On the contrary, if the distance between the bearings 313, 314 were unduly large, the overall length of the electric motor M would be so large that requirements for smaller motors would not be met.

In the embodiment shown in FIG. 18, the bearing 314 is positioned within the rotor 312. This arrangement makes it possible to increase the distance between the bearings 313, 314 without increasing the outer dimensions of the electric motor M. Furthermore, the bearing bracket 317 and the stator assembly 301 can be assembled with each other and disassembled from each other. The stator assembly 301 and the rotor assembly 310 which includes the bearing bracket 317 and the rotor 312 can be assembled separately from each other. Therefore, if electric motors with rated voltages of 200 V and 400 V, respectively, are to be manufactured, then identical pumps P and rotor assemblies 310 may first be assembled, and different stator assemblies 301 arranged to meet the different voltage requirements may finally be installed in position.

The outer ring 319*b* is held in engagement with the inner circumferential surface of the rotor 312, and the boss 319*a*is fixed to the shaft 311, with the outer ring 319*b* and the boss 319*a* being joined to each other by the ribs 319*c*. With this structure, the bearing 314 can easily be positioned in the rotor 312, and interior sides of the electric motor M which are close to and remote from the impeller 320 are held in communication with each other by a fluid that is typically air, thus the various parts of the electric motor M can be cooled under uniform conditions.

The ribs 319*c* are shaped as an impeller for producing an axial flow of air. When the rotor 312 rotates, the ribs 319*c* generates a positive air flow through the electric motor M for thereby cooling the rotor 312 and the bearings 313, 314. The window opening 317*a* defined in the side wall of the bearing bracket 317 eliminates a closed air space between the bearings 313, 314, for thereby effectively cooling the bearings 313, 314. A recess 303*a* defined in the core of the stator 303 is effective to cool the stator 303.

The motor frame 302 is of a cup shape, and the bearing bracket 317 is inserted into the interior space from the open end of the cup-shaped motor frame 302. The motor frame 302 can thus be pressed from a relatively thin metal sheet. Even if the motor frame 302 is to be in the form of an aluminum die casting, it can be manufactured with high productivity as it has a simple configuration.

The motor frame 302 has a hole 302*a* defined in a top wall thereof, and the hole 302*a* is closed off by a cap 329. If the temperature of the motor M exceeds a preset temperature for some reason, then the cap 329 is removed to open the hole 302*a* to introduce ambient air into the electric motor M to cool the electric motor M.

Figure 19:
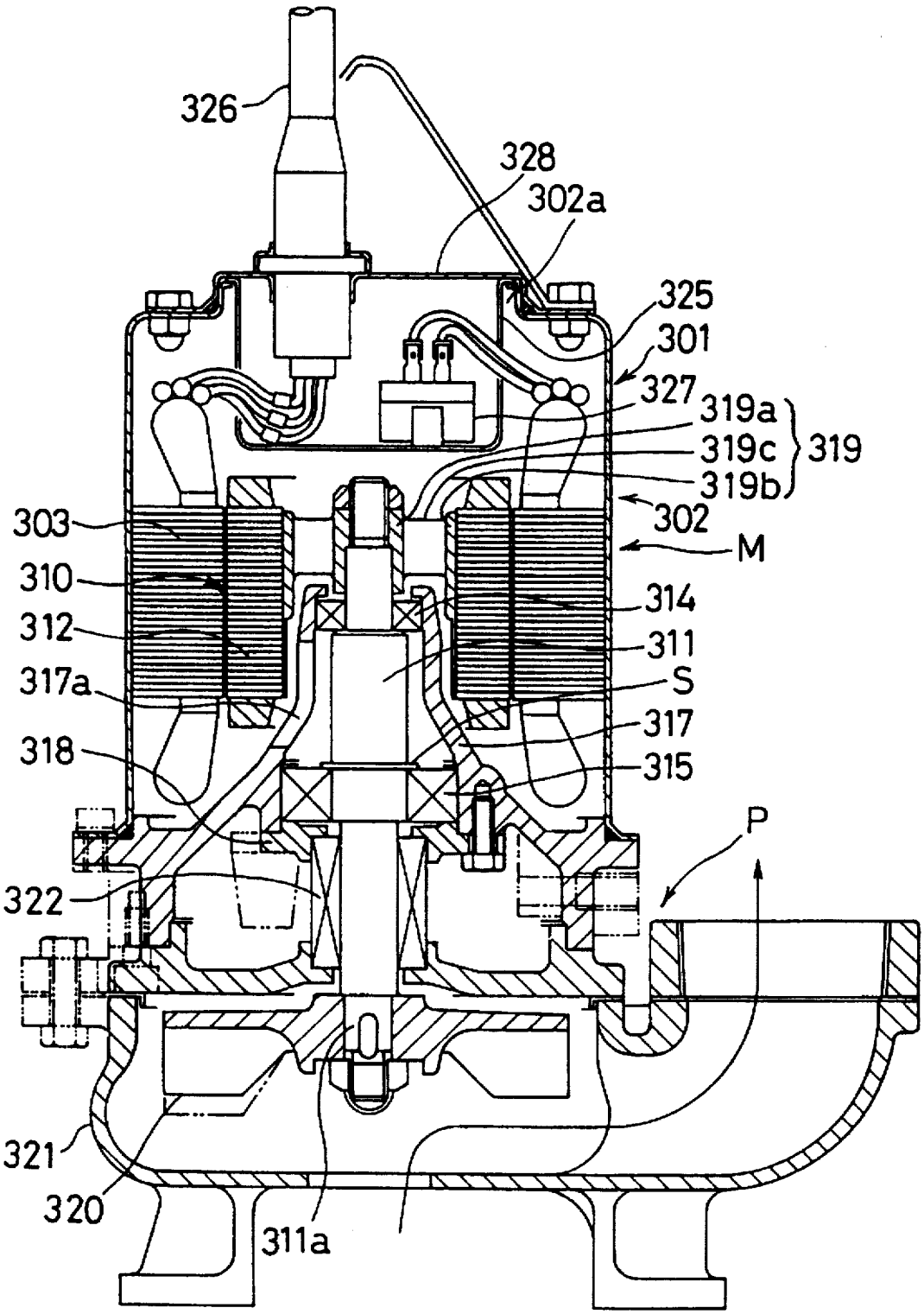
FIG. 19 is a cross-sectional view of an electric motor with cantilever bearings and a pump device which incorporates the electric motor, according to a tenth embodiment of the present invention.

FIG. 19 shows an electric motor with cantilever bearings and a pump device which incorporates the electric motor, according to a tenth embodiment of the present invention. Those parts shown in FIG. 19 which are identical in structure and function to those shown in FIG. 18 are denoted by identical reference characters, and will not be described in detail below.

In the tenth embodiment, the electric motor M is of substantially the same structure as the electric motor M shown in FIG. 18. However, a terminal box 325 is mounted in the hole 302*a* in the top wall of the motor frame 302. The terminal box 325 is closed by a motor cover 328. In FIG. 19, the pump device composed of the electric motor M and the pump is a submersible motor pump, and the submersible motor pump usually has a submersible cable 326 and a thermal protector 327 which are connected to and housed in the terminal box 325. Use of the terminal box 325 permits the electric motor M to be relatively small in size. Since the thermal protector 327 housed in the terminal box 325 can be positioned closely to the stator windings, the temperature of the stator windings can easily be detected for better protection of the electric motor M.

A vortex-type impeller 320 is fastened to the end 311*a* of the shaft 311, and housed in a pump casing 321.

In each of the above embodiments of FIGS. 18 and 19, as described above, the bearings can easily be maintained concentrically with each other, the motor frame can be manufactured with high productivity, and the electric motor can be small in size. Inasmuch as the stator assembly and the rotor assembly can be assembled independently of each other, the process of manufacturing the electric motor can be divided into separate processes for increased productivity. The electric motor can also easily be assemble and disassembled.

Although certain preferred embodiments of the present invention has been shown and described in detail, it should be understood that various changes and modifications may be made therein without departing from the scope of the appended claims.

What is claimed is:

1. A canned motor pump comprising:

a motor stator;

a stator can disposed radially inwardly of said motor stator;

a rotatable shaft;

a motor rotor fixedly supported on an end of said rotatable shaft and disposed radially inwardly of said stator can and around a portion of said rotatable shaft so as to form a fluid flow passage between said motor rotor and said portion of said rotatable shaft;

at least one connecting portion connecting said rotor to said portion of said rotatable shaft in said fluid flow passage and forming a portion of substantially minimum cross section of said fluid flow passage;

a pump impeller mounted on an opposite end of said rotatable shaft which pumps a fluid, substantially all of said fluid flowing through said fluid flow passage; and first and second radial bearings for supporting said rotatable shaft, said first and second radial bearings being concentric with each other and being axially disposed between said connecting portion passage and said pump impeller such that said first and second radial bearings are substantially axially offset from said at least one connecting portion.

2. The canned motor pump according to claim 1, further comprising thrust bearings for supporting said rotatable shaft, said thrust bearing being concentric and axially disposed between said motor rotor and said pump impeller.

3. The canned motor pump according to claim 1, further comprising a bearing bracket for supporting said radial bearings, wherein said bearing bracket is provided with a return guide vane for guiding said main flow to said fluid passage.

4. The canned motor pump according to claim 3, wherein said bearing bracket has a hole for removing air and water flowing through a rotor chamber in which said motor rotor is disposed.

5. The canned motor pump according to claim 1, further comprising a power supply cable connected to said motor stator and disposed in a vicinity of said pump impeller.

6. The canned motor pump according to claim 2, wherein at least one of said radial bearings and said thrust bearings is disposed in a rotor assembly in which said motor rotor is disposed.

7. The canned motor pump according to claim 1, further comprising a rotor support ring for supporting said motor rotor, said rotor support ring including a boss fixedly mounted on the shaft, an outer ring held in engagement with an inner circumferential surface of said motor rotor, and a plurality of ribs interconnecting said boss and said outer ring.

8. The canned motor pump according to claim 7, wherein said ribs are shaped as an axial-flow impeller.

9. The canned motor pump according to claim 1, wherein a stator assembly including said motor stator and said stator can, a rotor assembly including said motor rotor, said rotatable shaft and said bearings, and a pump casing assembly housing said pump impeller are assembled independently of each other.

10. The canned motor pump according to claim 9, wherein said rotor assembly and said pump casing assembly are assembled onto said stator assembly in one direction when said stator assembly, said rotor assembly, and said pump casing assembly are assembled together.

11. The canned motor pump according to claim 7, wherein said motor rotor includes a can side wall and a rotor can, said can side wall is sealingly welded to said rotor support ring, and said rotor can is sealingly welded to said can side wall.

12. The canned motor pump according to claim 11, wherein said motor rotor includes an end ring held by said can side wall and said rotor can, and said can side wallis tapered along an inner circumferential surface of said end ring to guide the fluid smoothly therealong.

* * * * *

UNITED STATES PATENT AND TRADEMARK OFFICE

CERTIFICATE OF CORRECTION

PATENT NO. : 5,692,886
DATED : December 2, 1997
INVENTOR(S) : Makoto Kobayashi, et. al.

It is certified that error appears in the above-identified patent and that said Letters Patent is hereby corrected as shown below:

Claim 1, line 21, please delete "passage".

Claim 12, line 3, please change "wallis" to --wall is--.

Signed and Sealed this

Nineteenth Day of May, 1998

Bruce Lehman

*Attest:*

BRUCE LEHMAN

*Attesting Officer*

*Commissioner of Patents and Trademarks*